US006484352B2

(12) United States Patent
Huebsch et al.

(10) Patent No.: US 6,484,352 B2
(45) Date of Patent: Nov. 26, 2002

(54) VACUUM CLEANER WITH THERMAL CUTOFF

(75) Inventors: John A. Huebsch, Bloomington; Christer T. Kontio, Bloomington; William R. Reimer, Normal, all of IL (US)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/899,010

(22) Filed: Jul. 3, 2001

(65) Prior Publication Data

US 2001/0039691 A1 Nov. 15, 2001

Related U.S. Application Data

(60) Continuation of application No. 09/550,571, filed on Apr. 17, 2000, now Pat. No. 6,308,374, which is a division of application No. 08/958,762, filed on Oct. 25, 1997, now Pat. No. 6,085,382.

(60) Provisional application No. 60/035,357, filed on Jan. 10, 1997.

(51) Int. Cl.[7] ..... A47L 9/28

(52) U.S. Cl. ..... 15/339; 15/412

(58) Field of Search ..... 15/339, 412, 319

(56) References Cited

U.S. PATENT DOCUMENTS

| | | | | |
|---|---|---|---|---|
| 1,603,020 | A | | 10/1926 | Boldt et al. |
| 1,616,566 | A | | 2/1927 | Barker |
| 1,759,947 | A | | 5/1930 | Lee |
| 1,802,228 | A | | 4/1931 | Witte |
| 1,820,350 | A | | 8/1931 | Dance |
| 1,953,340 | A | | 4/1934 | Doemling |
| 1,992,042 | A | | 2/1935 | Rurka |
| 2,039,860 | A | | 5/1936 | Watts |
| 2,183,737 | A | | 12/1939 | Bilde |
| 2,300,266 | A | | 10/1942 | Smellie |
| 2,394,798 | A | | 2/1946 | McNeal |
| 2,656,097 | A | | 10/1953 | Sheahan |
| 2,867,833 | A | | 1/1959 | Duff |
| 2,922,054 | A | | 1/1960 | Miller |
| 3,217,350 | A | | 11/1965 | Waters et al. |
| 3,218,876 | A | | 11/1965 | Berger |
| 3,273,195 | A | | 9/1966 | Jepson et al. |
| 3,279,157 | A | | 10/1966 | Andersson-Sason et al. |
| 3,343,199 | A | | 9/1967 | Nolte |
| 3,344,588 | A | | 10/1967 | Szabo |
| 3,353,338 | A | | 11/1967 | Nilsson |
| 3,383,765 | A | | 5/1968 | Meltzer |
| 3,451,495 | A | | 6/1969 | Bayless et al. |
| 3,466,696 | A | | 9/1969 | Grellsson |
| 3,491,519 | A | | 1/1970 | Ettridge |
| 3,510,904 | A | * | 5/1970 | Lagerstrom ..... 15/319 |
| 3,608,333 | A | | 9/1971 | Selley et al. |
| 3,614,860 | A | | 10/1971 | Grellsson |
| 3,618,687 | A | | 11/1971 | Ripple et al. |
| 3,675,268 | A | | 7/1972 | Nordeen |
| 3,721,071 | A | | 3/1973 | Mueller et al. |

(List continued on next page.)

FOREIGN PATENT DOCUMENTS

| | | |
|---|---|---|
| EP | 0 438 827 A1 | 7/1991 |
| GB | 769015 | 2/1957 |
| GB | 1 489 316 | 10/1977 |
| GB | 1 538 519 | 1/1979 |
| GB | 2 098 055 A | 11/1982 |
| GB | 2 144 625 A | 3/1985 |
| GB | 2 291 336 A | 1/1996 |

*Primary Examiner*—Chris K. Moore
(74) *Attorney, Agent, or Firm*—Pearne & Gordon LLP

(57) ABSTRACT

Disclosed is a unique and novel air filtrating, self-propelled upright vacuum cleaner. The filtration system utilizes a HEPA-rated air filter as a final filtering element. The disclosed vacuum cleaner contains numerous other features including a self-propelled drive mechanism.

1 Claim, 17 Drawing Sheets

U.S. PATENT DOCUMENTS 3,766,347 A 10/1973 Brooks et al.
3,854,164 A 12/1974 Schmitz
3,866,263 A 2/1975 Crouser et al.
3,938,216 A 2/1976 Schmitz et al.
3,962,746 A 6/1976 Johnson et al.
3,971,643 A 7/1976 Hufton
3,984,735 A * 10/1976 Schwartz ..... 15/339
4,015,308 A 4/1977 Rickmers
4,037,290 A 7/1977 Rose et al.
4,103,416 A 8/1978 Sakamoto
4,104,484 A 8/1978 Ijlstra et al.
4,108,268 A 8/1978 Block
4,124,916 A 11/1978 Fromknecht
4,193,604 A 3/1980 Sarvanne
4,249,281 A 2/1981 Meyer et al.
4,294,595 A * 10/1981 Bowerman ..... 15/339
4,347,643 A 9/1982 Bair
4,351,078 A 9/1982 Sternberg
4,364,146 A 12/1982 Bowerman
4,434,865 A 3/1984 Tschudy et al.
4,452,618 A 6/1984 Kuplas
4,523,117 A 6/1985 Daniels
4,554,700 A 11/1985 Lyman
4,554,701 A 11/1985 Van Raajj
4,581,787 A 4/1986 Torigoe et al.
4,613,348 A 9/1986 Natale
4,615,071 A 10/1986 Frohbieter
4,623,811 A 11/1986 Nystuen et al.
4,624,027 A 11/1986 Martin
4,648,150 A 3/1987 Morishita et al.
4,660,247 A 4/1987 Frohbieter et al.
4,709,124 A 11/1987 Wheeler et al.
4,709,443 A 12/1987 Bigley
4,710,658 A 12/1987 Stahl
4,726,825 A 2/1988 Natale
4,733,429 A 3/1988 Jacob et al.
4,739,535 A * 4/1988 Schuld et al. ..... 15/323
4,754,520 A 7/1988 Steadings et al.
4,766,640 A 8/1988 Martin et al.
4,798,984 A 1/1989 Suzuki et al.
4,805,521 A 2/1989 Eckebring et al.
4,838,907 A 6/1989 Perry
4,952,831 A 8/1990 Isozumi et al.
4,959,885 A 10/1990 Sovis et al.
4,960,446 A 10/1990 Werner et al.
4,970,753 A 11/1990 Herron
4,984,648 A 1/1991 Strzok
5,016,316 A 5/1991 McAllise et al.
5,092,915 A 3/1992 Lackner
5,115,537 A 5/1992 Meyer et al.
5,141,540 A 8/1992 Helmus
5,152,027 A 10/1992 LaBoda
5,187,832 A 2/1993 Meyer et al.
5,192,888 A 3/1993 Fleer
5,230,722 A 7/1993 Yonkers
5,247,719 A 9/1993 Wareham et al.
5,259,854 A 11/1993 Newman
5,279,018 A 1/1994 Glenn
5,285,550 A 2/1994 Meyer et al.
5,293,664 A 3/1994 Lim et al.
5,301,388 A 4/1994 Zeren
5,307,538 A 5/1994 Rench et al.
5,314,300 A 5/1994 Gatley et al.
5,331,715 A 7/1994 Johnson et al.
5,335,740 A 8/1994 Meyer et al.
5,339,916 A 8/1994 Louis
5,365,633 A 11/1994 Sunagawa et al.
5,406,674 A 4/1995 Lawter et al.
5,414,893 A 5/1995 Hampton et al.
5,444,315 A 8/1995 Adam et al.
5,564,160 A 10/1996 Luebbering
5,573,369 A 11/1996 Du
5,720,074 A 2/1998 Lee
5,784,753 A * 7/1998 Kaczmarz et al. ..... 15/319
6,167,588 B1 * 1/2001 Dyson ..... 15/339

* cited by examiner

VACUUM CLEANER WITH THERMAL CUTOFF

This is a continuation of application Ser. No. 09/550,571, filed Apr. 17, 2000, (now U.S. Pat. No. 6,308,374, issued Oct. 30, 2001) which is a divisional of application Ser. No. 08/958,762, filed Oct. 25, 1997 (now U.S. Pat. No. 6,085,382) which claims the benefit of U.S. Provisional Application No. 60/035,357, filed Jan. 10, 1997.

FIELD OF THE INVENTION

The present invention relates to a self-propelled upright vacuum cleaner comprising a unique HEPA-rated air filtration system. The present invention also relates to a self-propelled upright vacuum cleaner having a thermal cut-off circuit, a novel air routing configuration within the unit, and numerous other improvements and features.

There is an increasing emphasis upon the cleanliness of air discharged from vacuum cleaners. Prior artisans have attempted to provide secondary filters for vacuum cleaner exhaust air streams. Although satisfactory in most respects, most known secondary filtering configurations are difficult to design and incorporate within the vacuum cleaner, thereby increasing the complexity, manufacturing timer and cost of the unit. Furthermore, for assemblies employing replaceable filter elements, there is often considerable difficulty in replacing the element, particularly if it is located within the vacuum cleaner. Accordingly, there is a need for a vacuum cleaner comprising a secondary filtering assembly that overcomes the problems of the prior art. It would be particularly desirable to provide a vacuum cleaner with an easily replaceable filter element in combination with a sealed air path so that all air exiting the vacuum cleaner unit traveled through the filter prior to exiting the vacuum cleaner.

Air leaks from a vacuum cleaner unit, such as leakage of the exhaust stream around the motor housing into the environment, not only introduce particulates and contaminants into the outside environment and thus bypass any secondary filter if so provided, but also decrease the overall efficiency of the unit. Thus, there is a need for a vacuum cleaner providing an improved internal air routing configuration which prevents or at least significantly minimizes exhaust air leaks in and around the lower enclosure, and particularly around the motor housing.

It is desirable to provide a sensor and electrical circuit to stop operation of the vacuum cleaner motor in the event that the temperature of the motor exceeds a predetermined temperature. Heating of the motor typically results from a blocked or plugged filter, or from one or more objects interfering with the operation of the rotating brush or floor element. Prior artisans have incorporated temperature sensors and motor switching circuits in vacuum cleaners. However, as far as is known, none of the known sensors and switching circuits utilized in vacuum cleaners provide an automatic reset feature. That is, all known vacuum cleaners with on board temperature sensors may be started immediately after the sensor sufficiently cools. Although satisfactory in most respects, this configuration still enables electrical power to be applied to the motor. This may result in damage to the motor, in the event the motor is bound or otherwise locked. Accordingly, there is a need for an improved temperature sensing and motor interlock circuit whereby a reset operation is performed to ensure that electrical power is not inadvertently directed to a locked motor.

Self-propelled vacuum cleaners are known. However, much of the design and engineering efforts directed to such units are focused upon the drive assembly and vacuuming function. There remains an opportunity to improve other aspects of self propelled vacuum cleaners such as their noise level, electrical safety considerations, life of components such as the motor bearings, connections for an accessory hose, and configuration of the operator handle.

SUMMARY OF THE INVENTION

The present invention achieves all the foregoing objectives and provides in a first aspect, a vacuum cleaner comprising a housing and a base unit pivotally attached to each other, a motor and motor housing disposed within the base unit, a drive assembly also disposed within the base unit and selectively coupled to the motor, a nested wand releasably retained along the exterior of the housing, a lower air conduit extending between the base unit and a lower end of the wand, and an upper air conduit extending between an upper end of the wand and a suction chamber defined within the housing.

In another aspect, the present invention provides a vacuum cleaner comprising a lower base unit, an upper pivotable enclosure for housing a filter bag, a motor disposed within the lower base unit, a power cord and associated electrical conductors defining an electrical power circuit to the motor, and a thermal cutoff assembly including a temperature sensor disposed proximate to the motor for measuring the temperature of the motor, the thermal cutoff assembly including a switching element in the electrical power circuit that opens upon the temperature sensor sensing a temperature greater than a predetermined temperature setpoint.

In yet another embodiment, the present invention provides a vacuum cleaner comprising a lower base unit, an upper enclosure for retaining a filter bag, the upper enclosure defining a suction chamber, and exhaust chamber, and an exhaust opening providing access from the exterior of the upper enclosure to the exhaust chamber, a motor and fan assembly disposed within the upper enclosure and in airflow communication between the suction chamber and the exhaust chamber, and a detachable filter assembly that releasably engages the upper enclosure at or near the exhaust opening.

In yet another aspect, the present invention provides a vacuum cleaner comprising a lower base enclosure, an upper enclosure having internal walls dividing the upper enclosure into a suction chamber, an exhaust chamber, and a motor chamber, a motor and fan assembly disposed in a shroud which resides in the motor chamber, an air intake duct extending between the suction chamber and the shroud. The air intake duct engages either or both the suction chamber and the shroud along an unsealed interface.

According to a further aspect of this invention a motor and transmission module selectively powers a base drive wheel and at least the motor of the module is encased in a shroud. The shroud is connected by an exhaust passageway to the air flow path leading ultimately to the final filter.

DESCRIPTION OF THE PREFERRED EMBODIMENTS

Figure 1:
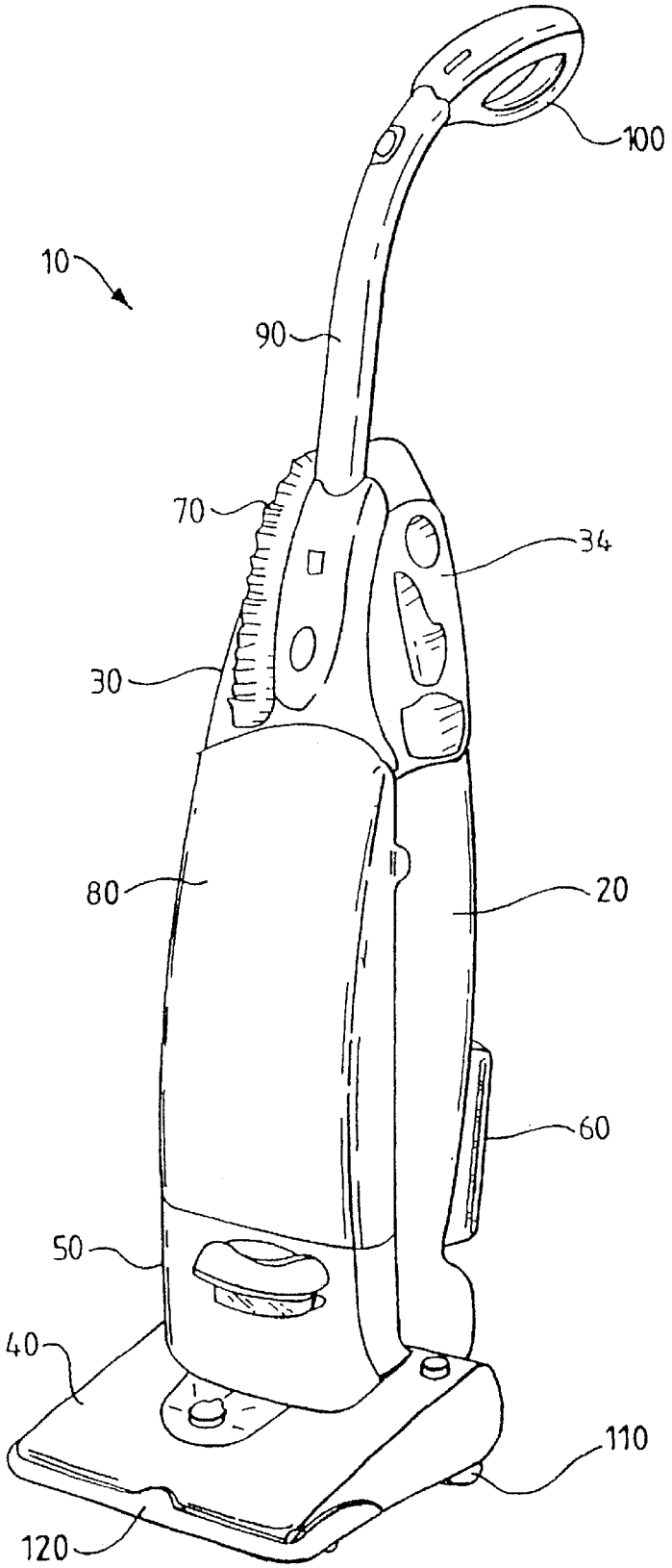
FIG. 1 is a perspective view of a preferred embodiment vacuum cleaner in accordance with the present invention.

Referring to FIGS. 1, 1A, 1B and 3, a preferred embodiment vacuum cleaner 10 in accordance with the present invention is illustrated. The vacuum cleaner 10 comprises a rear housing 20, an upper front cover 30, a bag cover 80, and a lower motor cover 50 that generally form the body of the vacuum cleaner 10. The lower portion of the preferred embodiment vacuum cleaner 10 comprises an,upper base 40 having a front guard 120 and a plurality of wheels including rear wheels 110. The upper portion of the preferred embodiment vacuum cleaner 10 further comprises a handle 90, a grip 100, and a side mounted tool caddie insert 34. Disposed along the rear of the vacuum cleaner 10 is a final filter 60.

Figure 1A:
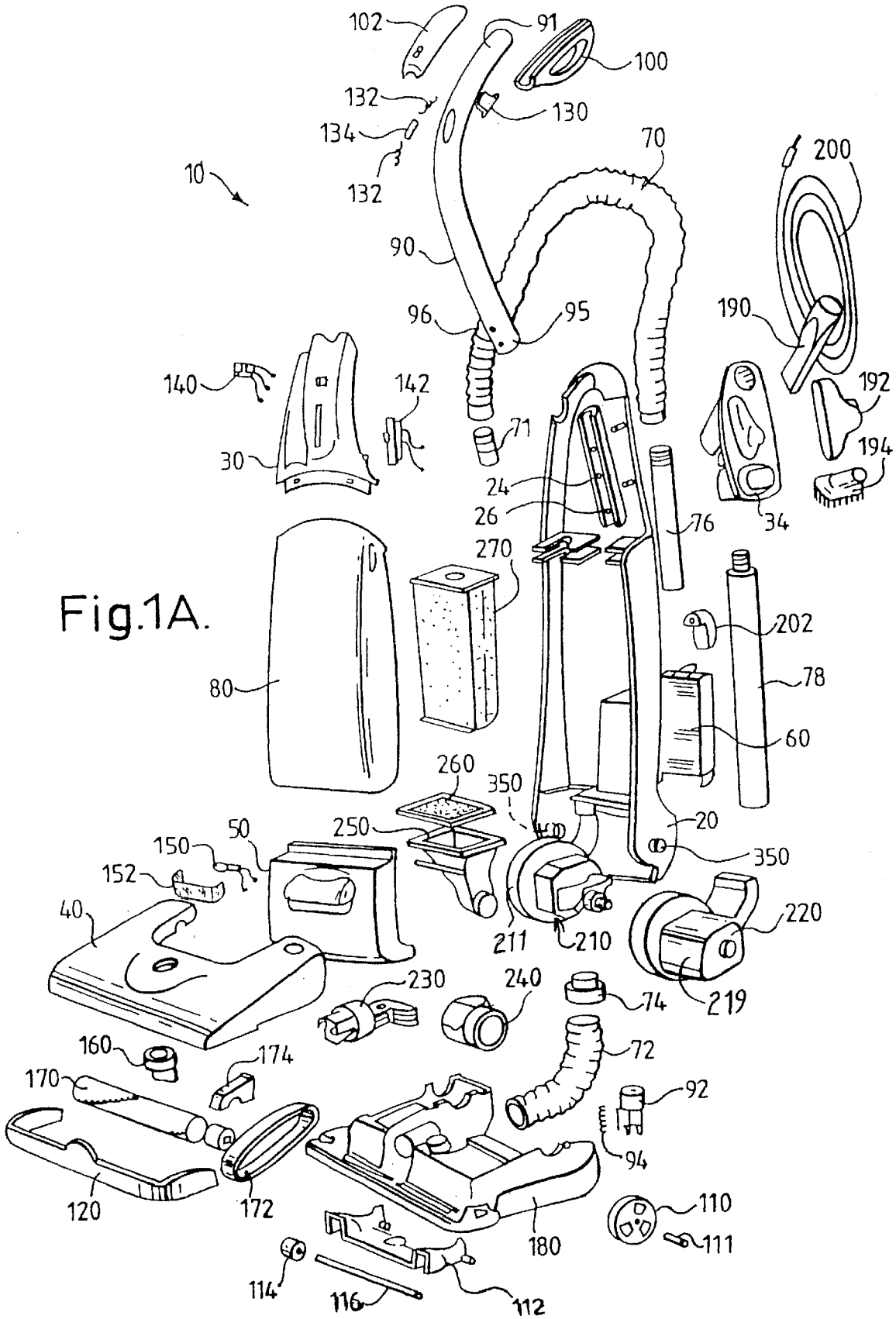
FIG. 1A is an exploded view of the preferred embodiment vacuum cleaner illustrated in FIG. 1.

Referring specifically to FIG. 1A, other components of the preferred embodiment vacuum 10 are as follows. The handle 90 is disposed between the front cover 30 and the upper portion of the rear housing 20. The handle 90 preferably has an arcuate bend proximate to its upper distal end 91. The bend is such that the distal end 91 is directed toward the rear of the vacuum cleaner 10. The grip 100 is affixed to a handle cover 102 and this assembly is slidably mounted on the upper distal end 91 of the handle 90. Various switches and controls may also be provided proximate to the distal end 91 of the handle 90 such as, but not limited to, a neutral lock mechanism 130 and related selector springs 132 and a selector spacer 134. In addition, one or more switches may be located at the distal end 91 of the handle 90 for controlling the operation of the vacuum cleaner 10. Other controls such as an on/off switch 140 and various potentiometer type controls such as a slide control 142 are preferably disposed and affixed to the front cover 30.

The upper base 40 and a lower base 180 engage each other and generally form a lower enclosure that houses the drive motor and brush assembly as follows. A drive motor 230 is disposed and retained within the enclosure formed by the upper base 40 and the lower base 180. The drive motor 230 is operatively coupled to a transmission 240 that also resides within the enclosure formed by the upper and lower bases 40 and 180. Rotatably secured to, or retained within, the lower base 180 are a plurality of wheels. A pair of rear wheels 110 are rotatably affixed to the lower base 180 by respective axles 111. Disposed proximate the front of the lower base 180 is a wheel carriage 112 that rotatably supports a front axle 116 having a pair of front wheels 114 secured at its ends. Also disposed within the enclosure formed by the upper base 40 and the lower base 180 is a rotatable brush or disturbulator 170. The disturbulator 170 is rotated by a disturbulator belt 172. A belt cover 174 is utilized to cover the belt 172.

Referring further to FIG. 1A, preferably disposed proximate to the lower portion of the rear housing 20 are a suction motor 210 and a motor shroud 220. The suction motor 210 draws air through the enclosure formed by the upper and lower bases 40 and 180, i.e. in the vicinity of the disturbulator 170, through a lower hose 72, a nested wand 78, an upper hose 70, a bag filter 270 disposed within a bag chamber described below, a second filter 260, an air intake duct 250, through the motor shroud 220 and eventually into the final filter 60 as described in greater detail below. A single screw is utilized for engaging the lower hose 72 connector to the lower base 180. A hose union 74 and other conventional coupling assemblies may be used to complete the airway. A unique releasably locking hose adapter 71, described in greater detail below, is preferably utilized to couple the upper hose 70 to the bag chamber within the rear housing 20.

An electrical power cord 200 and one or more cord release members 202 are provided along the rear of the vacuum cleaner 10. The power cord 200 provides electrical power to the suction motor 210 and the drive motor 230. The preferred embodiment vacuum cleaner 10 also comprises a headlight 150 and a lens 152 disposed in or upon the motor cover 50. A height adjustment assembly and knob 160 is provided for the lower base unit.

Figure 3:
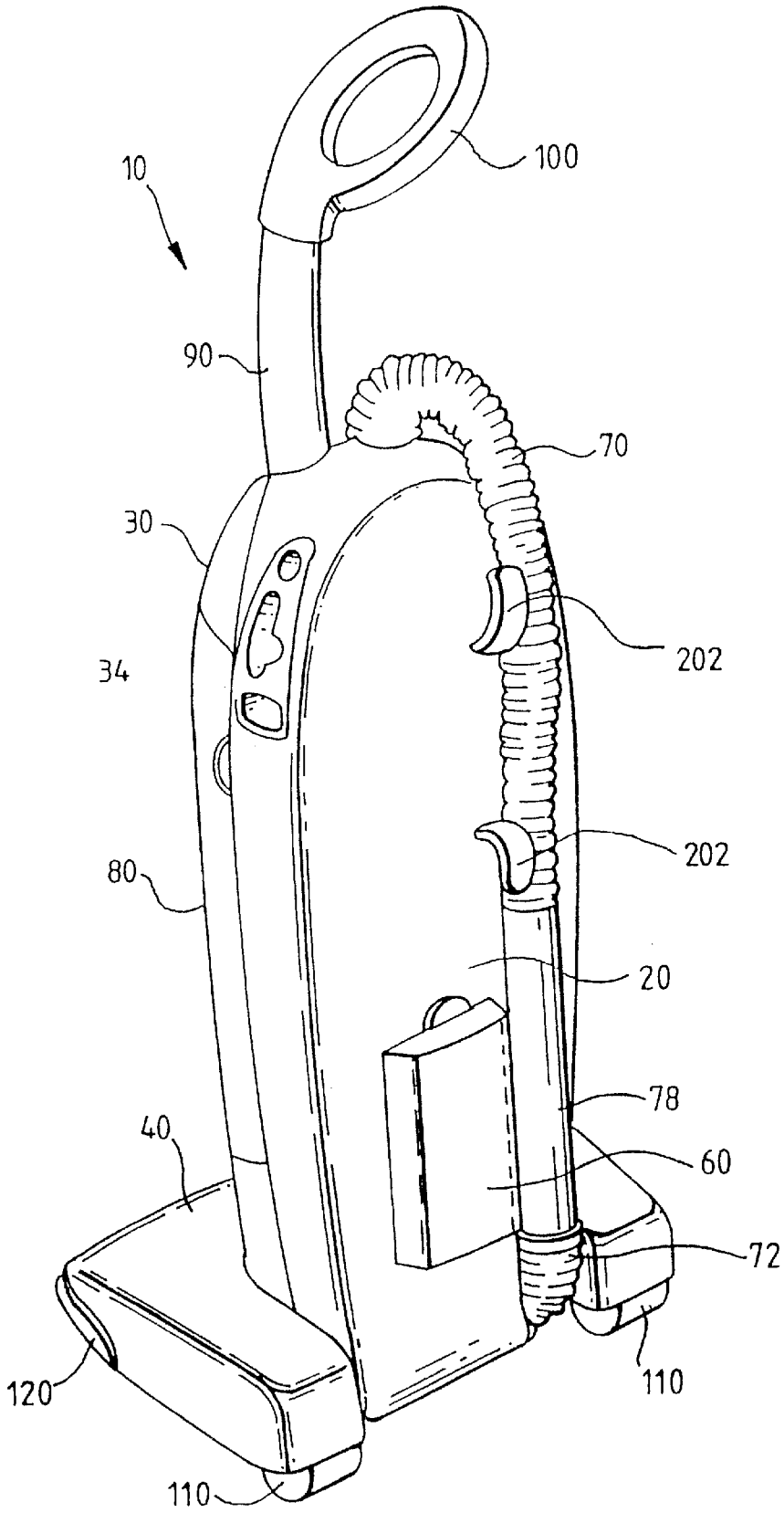
FIG. 3 is a perspective view of the rear of the preferred embodiment vacuum cleaner.
Figure 4:
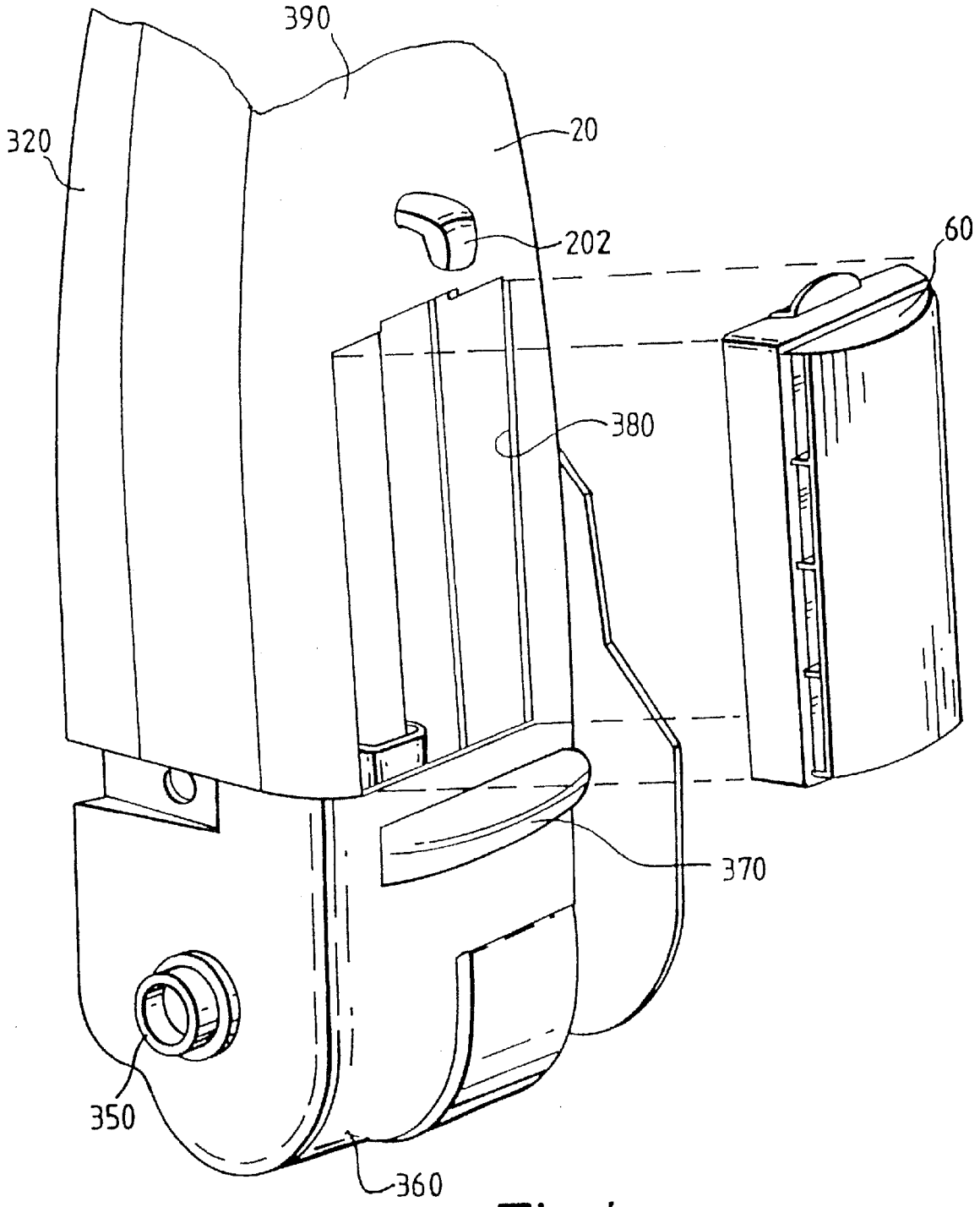
FIG. 4 is a detailed view illustrating the affixment of a preferred embodiment detachable filter to the rear housing of the preferred embodiment vacuum cleaner.
Figure 4A:
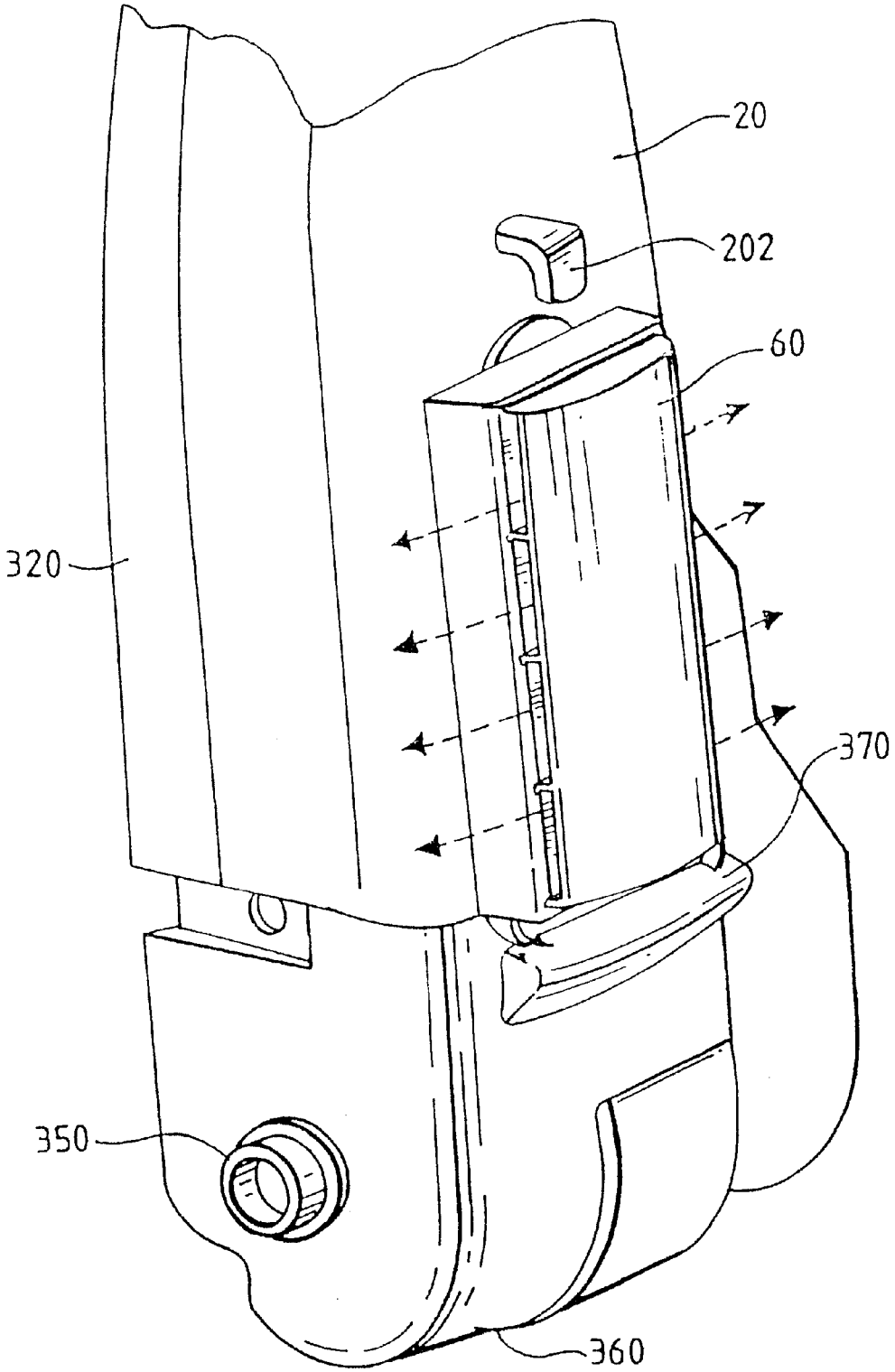
FIG. 4A illustrates the filter shown in FIG. 4 attached to the rear housing and the direction of airflow from the preferred embodiment vacuum cleaner.

The preferred embodiment vacuum cleaner also comprises a variety of cleaning tools or attachments. A side mounted tool caddie insert 34 is preferably utilized to releasably retain these tools such as for instance a crevice tool 190, an upholstery nozzle 192, and a brush 194. An extension wand 76 is also provided. An attachment tool is utilized by detaching the hose 70 from the nested wand 78 at their coupling along the rear of the vacuum cleaner 10, as best depicted in FIG. 3. Upon release of the hose 70 from the nested wand 78, one of the previously noted tools 190, 192, or 194, or the extension wand 76 can be attached to the free end of the hose 70.

Figure 1B:
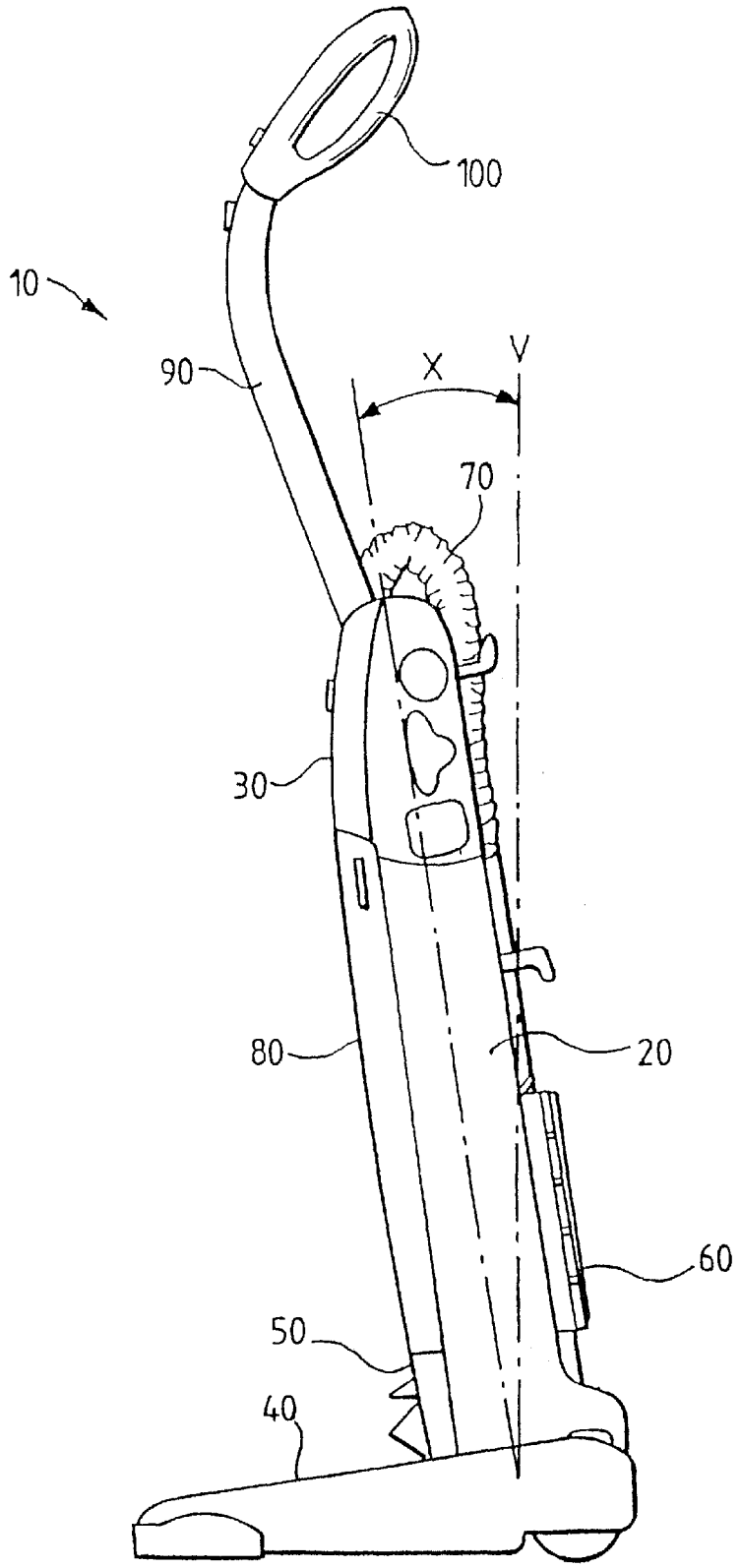
FIG. 1B is a side elevational view of the preferred embodiment vacuum cleaner illustrated in FIG. 1.

Referring to FIG. 1B, another aspect of the preferred embodiment vacuum cleaner 10 is the orientation of the upper housing and handle 90 to the base when the vacuum cleaner 10 is in its stationary upright position. This position is reached when the vacuum cleaner is placed in its accessory vacuuming mode. As evident in FIG. 1B, the upper housing is preferably oriented forward at some angle X from vertical. This orientation results in a more stable assembly than if the upper housing were oriented along a generally vertical axis. This becomes increasingly important as the bag filter 270 (shown in FIG. 1A) fills up with dirt and debris, thereby increasing in weight. It is most preferred that the angle X be about 8½°. The present invention vacuum cleaners, include other configurations in which the upper housing and handle are angled forward.

Referring further to FIG. 1A, a conventional handle release 92 and a release spring 94 control the angular orientation of the upper portion of the vacuum cleaner housing and handle. The handle 90 and related attachments such as switches and grips, may be entirely detachable from the vacuum cleaner 10, or designed to pivot so that the assembly may be folded downward toward the floor to a horizontal, or substantially horizontal, position. It is also contemplated that the handle could be mounted within the upper portion of the vacuum cleaner body in such a way that the handle becomes the movable portion or actuator utilized to control the operation of the vacuum cleaner. This would eliminate providing selector controls at the end of the handle 90 such as the selector 130. In this contemplated embodiment, the linkage connection to the control cable, i.e. a sheathed transmission shifting cable described below, would occur within the top portion of the vacuum cleaner body or housing. In many or all of these embodiments, it is further contemplated that the handle 90 could be designed so that it could be readily removed from the main housing of the vacuum cleaner. This would significantly reduce the size of the shipping carton and reduce shipping costs. Other advantages would likely include quick customer assembly and reduction in the number of parts and parts costs. A reduction in the size of shipping carton and parts would further allow the packaged product to be more easily displayed in the sometimes restricted shelf area found in many retail stores.

It is also preferred to utilize a tilt switch, preferably disposed within the handle 90, that prevents operation of the drive motor 230 depending upon the position of the handle. Preferably, the switch opens or closes an electrical control circuit depending upon the angular orientation of the handle. A switch comprising a ball bearing and raceway is disposed within the handle 90 and oriented such that when the handle is in an upright position, the ball bearing rolls or otherwise moves to a location along the raceway that results in an open electrical circuit between the switch terminals. The switch is also oriented so that when the handle is at any other position than its upright position, i.e. and so typically at some angle of inclination, the ball bearing rolls or moves to a location along the raceway that results in completion of the electrical pathway between the switch terminals. The tilt switch is preferably utilized in a control circuit governing operation of the drive motor 230 so that when the handle is in its upright position, the drive motor 230 will not operate. It is also contemplated that other types of switches utilizing other types of movable elements could be used. Furthermore, other types of interlocking switches could be used to prevent operation of the drive motor 230 when the handle 90 is in its upright position. It is envisioned that electrical contacts could be provided between the tiltable body portion of the vacuum cleaner and the base portion. The electrically conductive contacts would contact one another only when the handle was tilted from its upright position. The contacts would be incorporated into an electrical control circuit governing operation of the drive motor 230. Moreover, the location and placement of the switch could be elsewhere besides the handle, such as for instance, within the housing or base units of the vacuum cleaner.

The various housing, cover, and base components described herein can be formed from a wide array of materials. A preferred material is molded polyurethane.

Figure 2:
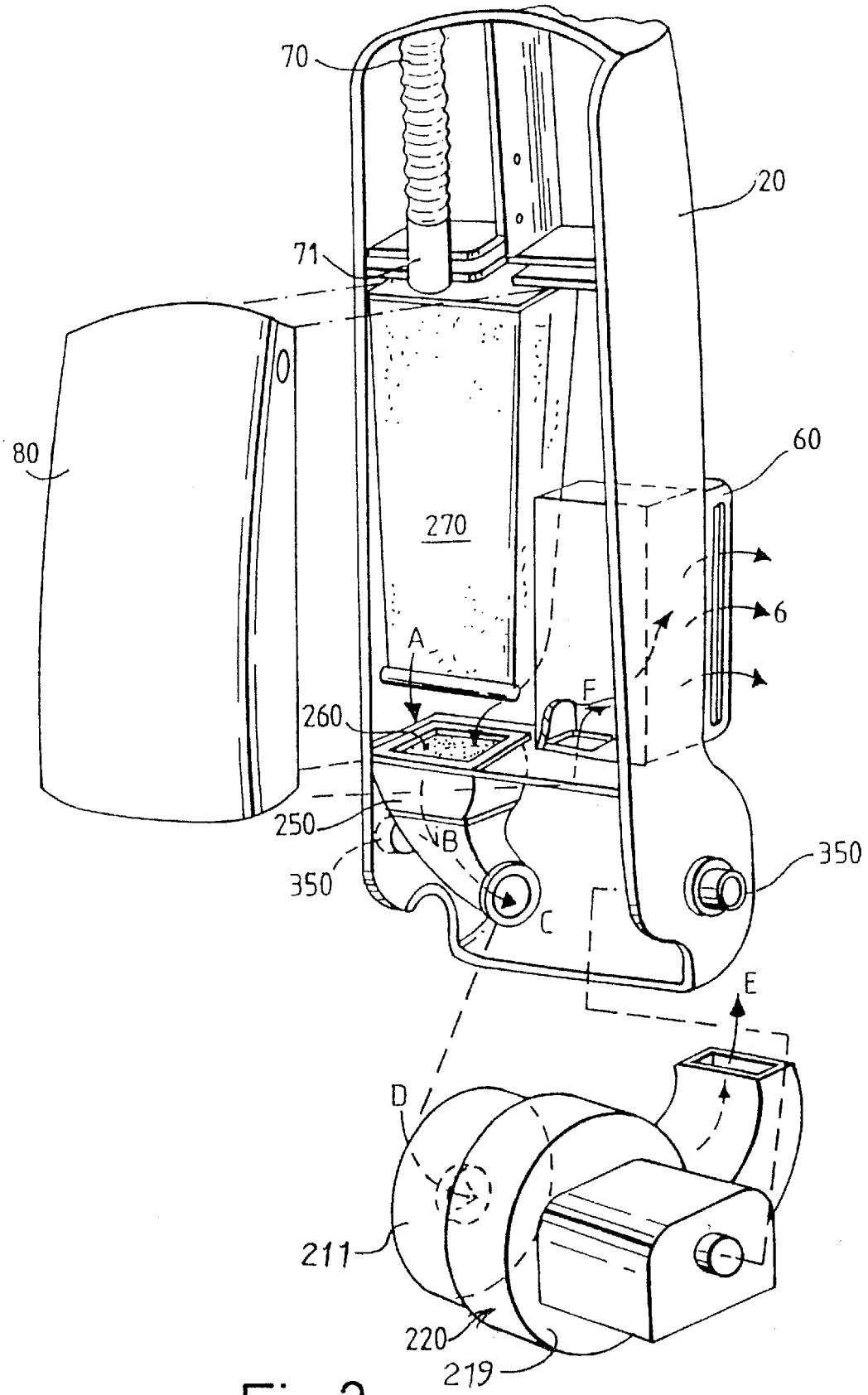
FIG. 2 is a partial exploded view of the preferred embodiment vacuum cleaner housing, illustrating in greater detail the direction of airflow within the housing.

The preferred embodiment vacuum cleaner 10 utilizes a unique and novel filtered airflow system as follows. Referring to FIG. 2, upon operation of the suction motor 210 generally disposed within the motor shroud 220, air is drawn through the hose 70 and through the hose adapter 71 into the bag filter 270. After passing through the walls of the bag filter 270, shown as arrow A in FIG. 2, air enters a secondary filter 260 located at the inlet of the air intake duct 250 Air passes through the air intake duct 250 shown as arrow B until it exits the duct 250 at the outlet shown as arrow C. The air then enters the inlet of the motor shroud 220, shown as arrow D, and then is directed through the outlet of the motor shroud 220 shown as arrow E. The air is then directed to the final filter 60 as shown by arrow F. After passing through the final filter 60, the air then exits the vacuum cleaner 10 through laterally oriented airflow openings along the side of the final filter 60 and described in greater detail below. The air exits as shown as arrows G.

A bag chamber, i.e. an interior region that houses the bag filter 270, is formed between the rear housing 20 and the bag cover 80. During operation of the vacuum cleaner 10, the bag chamber is usually at a negative pressure, i.e. a pressure less than atmospheric pressure.

The preferred embodiment motor shroud 220 generally encloses the suction motor 210 and diverts all air through the final filter 60. This configuration greatly simplifies gasket design and sealing issues otherwise encountered if a multi-component housing or shroud assembly was used. Although a one-piece sealed shroud enclosing the suction motor is preferred, the present invention includes additional embodiments including the use of a by-pass duct located either upstream, downstream, or on both ends of the suction motor. Other sealed enclosures are contemplated wherein the sealing is accomplished by conventional gaskets, adhesives or component welding.

Figure 2A:
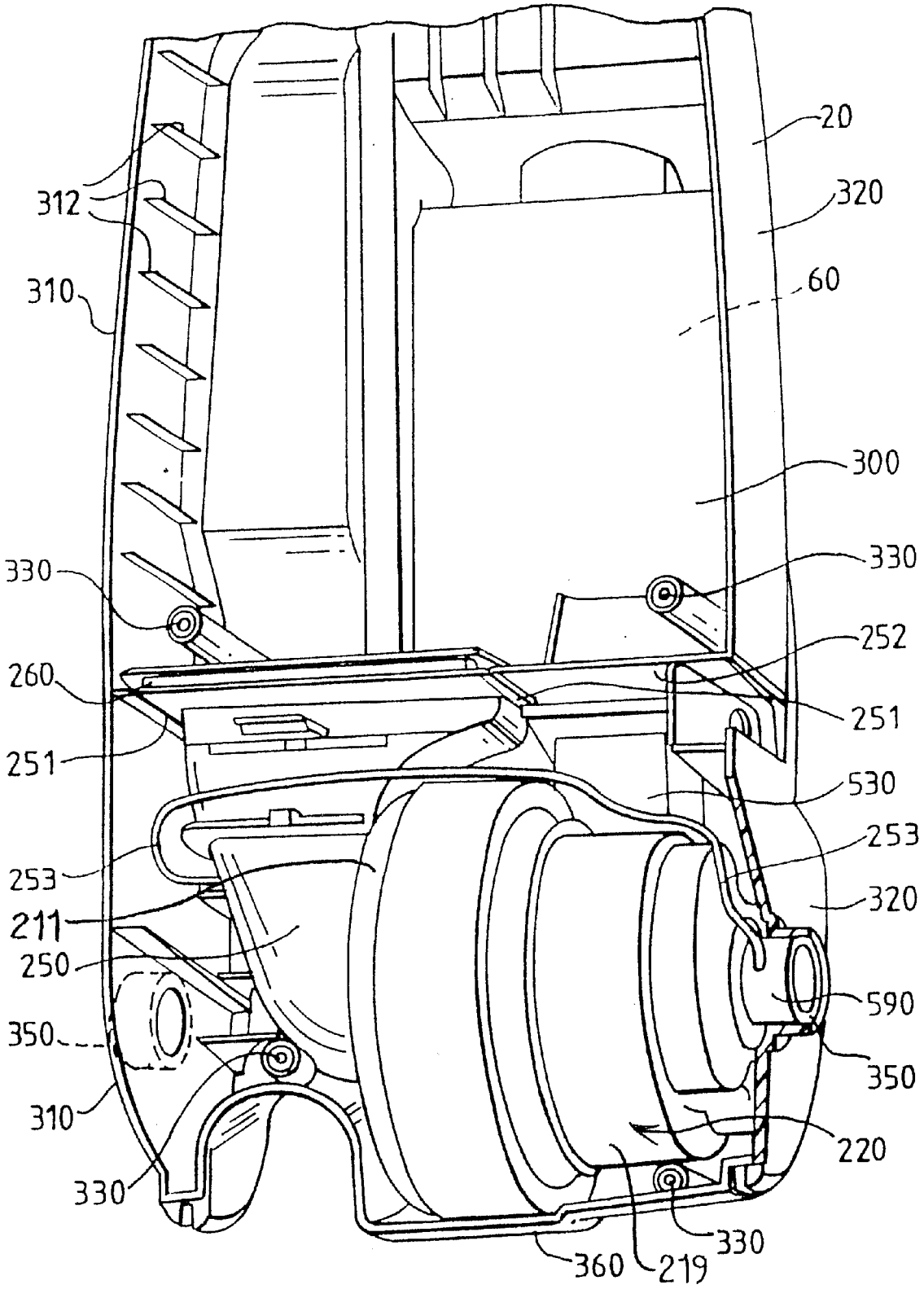
FIG. 2A is a detailed view of the assembled housing shown in FIG. 2 having a bag cover removed.
Figure 2B:
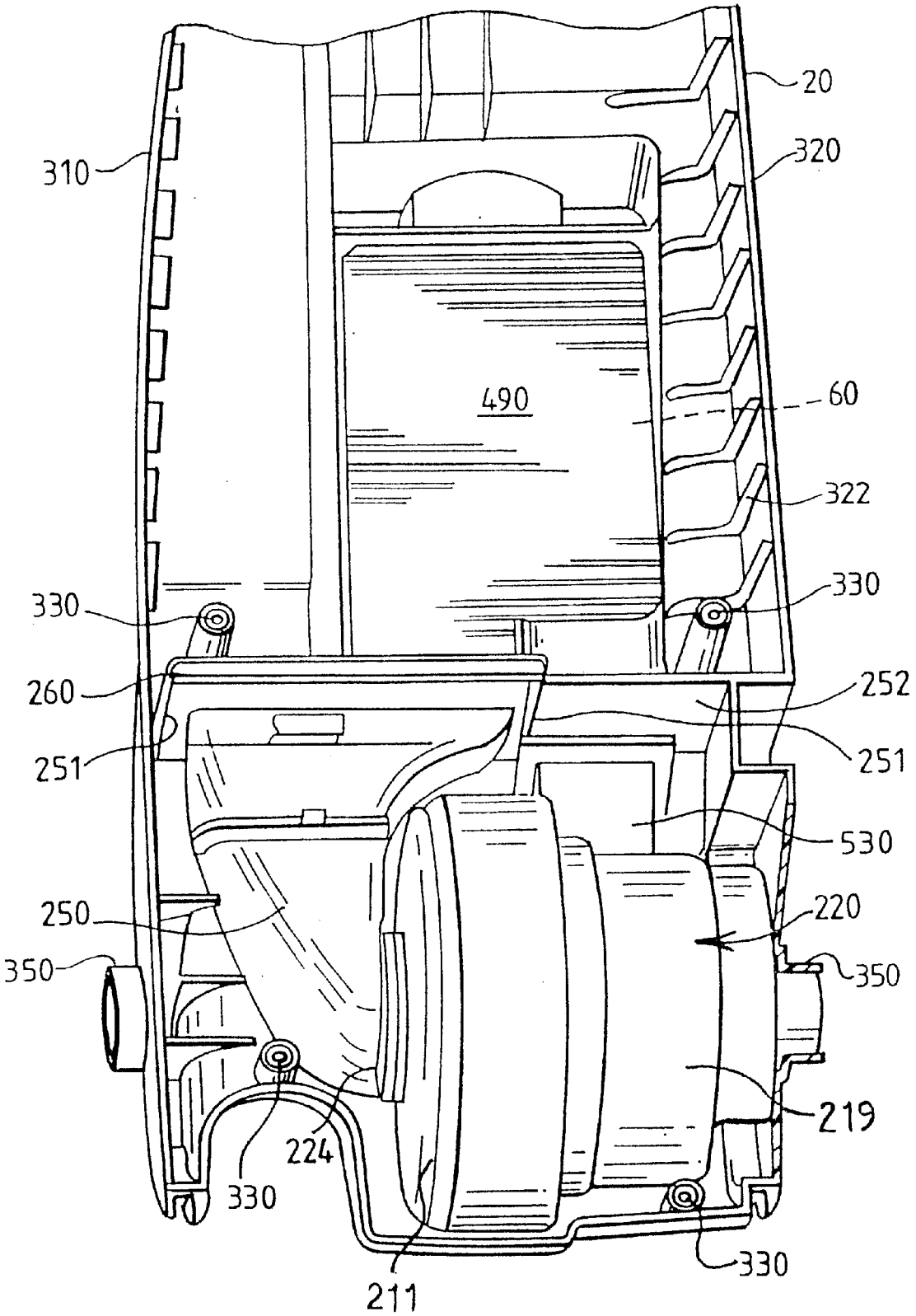
FIG. 2B is another view of the housing shown in FIG. 2 with the bag cover removed.

In a most preferred embodiment, air leaks are significantly reduced by recirculating airflow within the vacuum cleaner housing. Specifically, provisions are made to prevent exhaust air leaks from escaping to the environment before passing the air through the final filter 60. This is accomplished by maintaining a negative pressure inside the vacuum cleaner housing, and particularly within the enclosure formed between the rear housing 20 and the bag cover 80. This region of negative pressure may also extend in the vicinity behind the front cover 30. Referring to FIGS. 2A and 2B, it is most preferred to use an ungasketed joint between the air duct 250 and a mounting shelf 252 provided in the rear housing 20. The mounting shelf 252 defines an opening sized to accept and preferably support an end of the air duct 250. The interface between the opening and the outer periphery of the air duct 250 is shown in FIGS. 2A and 2B as interface 251. This interface is most preferably not sealed. As a result, exhaust leaks occurring in and around the upper portion of the air duct 250 are drawn into the bag chamber. Similarly, by providing an ungasketed joint between the lower region of the air intake duct 250 and the inlet of the motor shroud 220, shown in FIG. 2B as joint 224, potentional exhaust leaks in and around a gasketed joint between the lower portion of the air duct 250 and the suction motor 210 are drawn back into the motor shroud 220. As can be seen, potential exhaust leaks from the positive pressure side of the air handling system are recaptured into the airstream instead of being exhausted to the environment before passing the airstream through the final filter 60. This is achieved by maintaining a negative pressure inside the body or housing of the vacuum cleaner 10. The negative pressure inside the body or housing is due to inherent and/or predetermined leaks between the various airflow handling components which allow air to enter the air intake duct 250 and the bag chamber.

In another preferred embodiment, a flexible conduit shown in FIG. 2A as conduit 253 is provided between the motor bearings and the suction side or negative pressure side of the system. The conduit and resulting air flow through the conduit captures particles and contaminants otherwise leaking through the bearing or around the bearing and into the atmosphere. In the absence of such conduit, particles and contaminates leak from inside the enclosure or motor shroud to the outside environment. Another advantage of providing the flexible conduit 253 is that the resulting airflow therethrough draws air through and around the bearing thereby cooling the bearing and neighboring components. Preferably and with reference to FIGS. 2A and 8, the conduit 253 extends from a collar 590 disposed proximate a motor bearing. The conduit 253 extends to a location of lesser pressure, such as within the air duct 250. Other installation sites for the end of the conduit 253 may be utilized instead of the air duct 250. For instance instead of terminating the end of the conduit 253 at the air duct 250, that end could be installed on the shelf 252 so that the conduit 253 is in communication with the region of the enclosure behind the filter wall 300.

The preferred embodiment vacuum cleaner 10 utilizes a HEPA-rated final filter 60 best shown in FIGS. 4, 4A, 5, 6, and 7. The HEPA filter captures at least 99.97% of particles having a diameter of about 0.3 microns. The rear housing 20 is particularly adapted for accommodating the final filter 60. The rear housing 20 preferably comprises a rear wall 390 disposed between transversely extending first and second sidewalls 310 and 320, respectively. A bottom arcuate wall 360 is provided that generally extends in the same direction as the sidewalls 310 and 320. Defined generally within the center of the rear wall 390 is an opening 380 through which exiting air passes into the final filter 60. The final filter 60 is detachably retained along the rear of the rear housing 20. The final filter 60 is preferably supported by a support ledge 370.

The rear housing 20 further includes a filter wall 300 that partitions the interior of the vacuum cleaner 10, i.e. the bag chamber, from the final filter 60. Referring to FIG. 2A, the filter wall 300 segregates the filter 60, disposed on the rear face of the rear housing 20, from the bag chamber generally defined between the sidewalls 310, 320 and the shelf 252. FIG. 2B is similar to FIG. 2A but illustrates the assembly with the filter wall 300 removed. Other structural aspects of the rear housing 20 are illustrated in FIGS. 2A and 2B. One or more support ribs 312 and 322 may be provided along either or both of the side walls 310 and 320. One or more fastening bosses 330 are also provided for threadedly engaging fasteners or releasable clips that may be used for securing the motor cover 50, the bag cover 80, or the front cover 30 to the rear housing 20.

Figure 5:
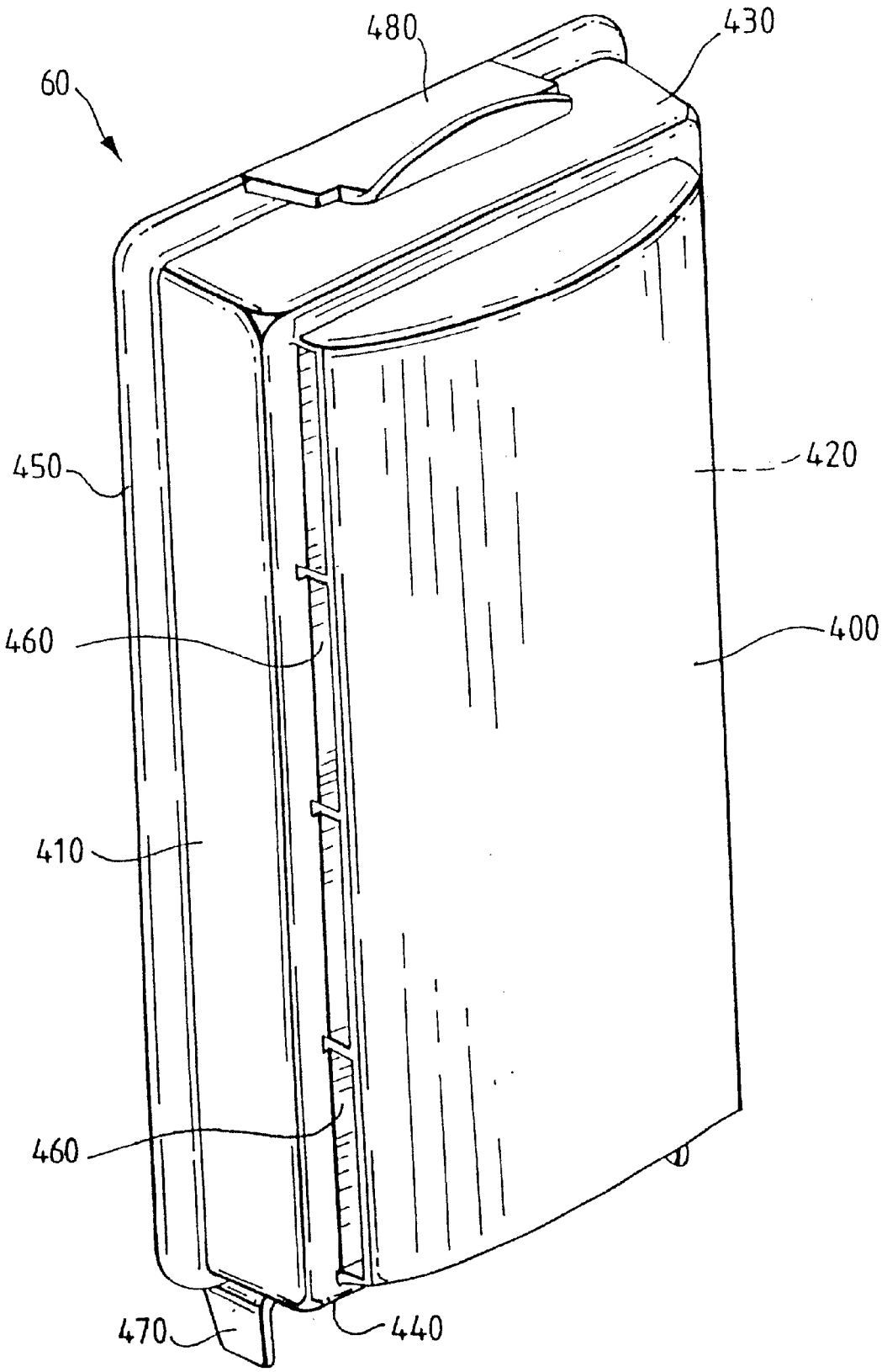
FIG. 5 is a detail of the preferred embodiment filter used in the preferred embodiment vacuum cleaner.
Figure 6:
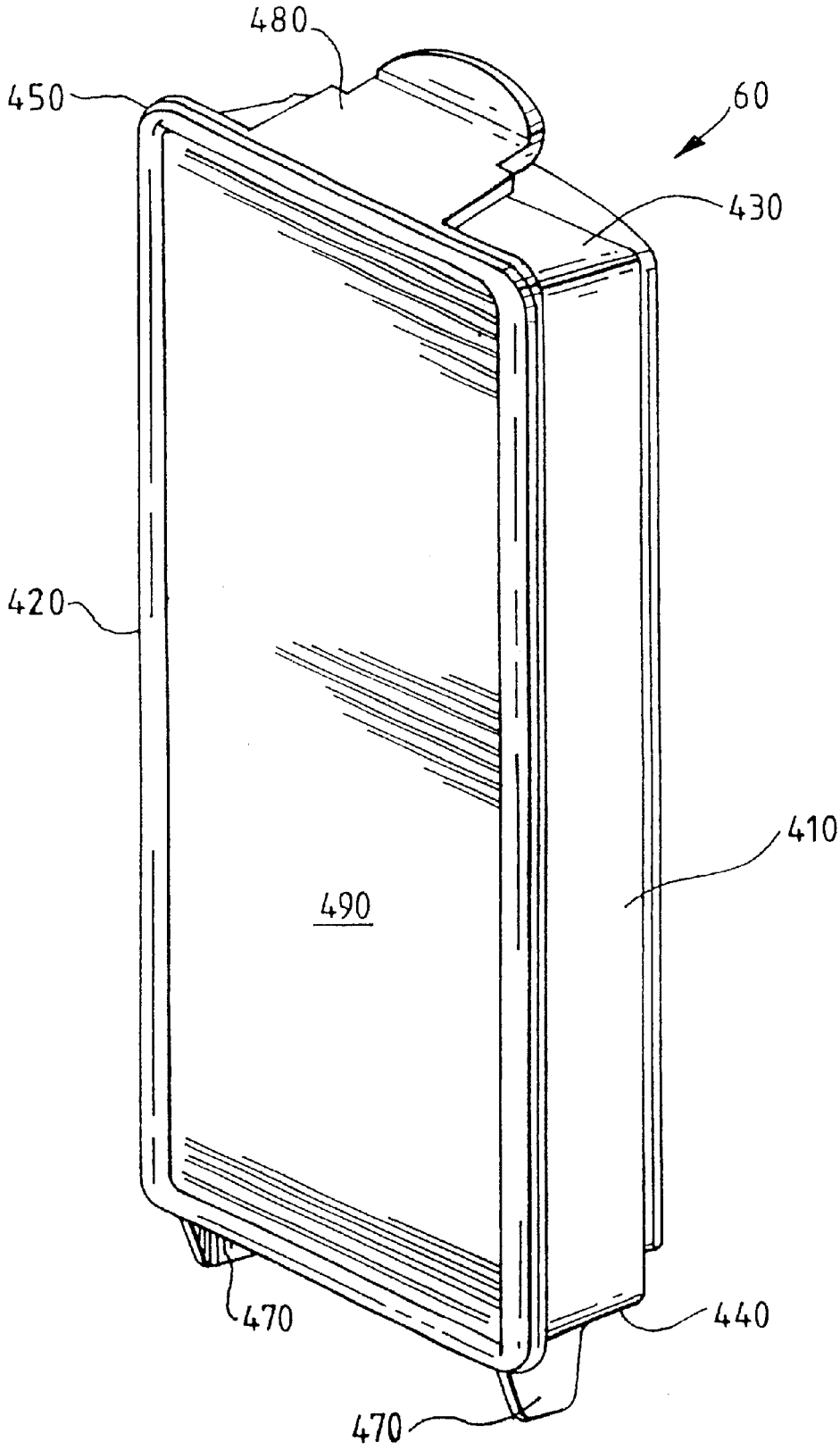
FIG. 6 is another view of the preferred embodiment filter.

Specifically referring to FIGS. 5 and 6, the preferred embodiment final filter 60 generally comprises a filter outer cover plate 400 disposed between a plurality of transversely extending walls such as a first side wall 410, a second side wall 420, a top wall 430, and a bottom wall 440. A peripheral skirt 450 extends around the perimeter of the final filter 60 and provides a mounting lip or seat for sealing against the rear housing 20 when the final filter 60 is attached to the rear of the vacuum cleaner 10. A plurality of airflow openings 460 are defined along the lateral regions of the final filter 60. The final filter 60 may also comprise one or more bottom legs 470 that engage the rear housing 20 of the vacuum cleaner 10 when the final filter 60 is attached to the vacuum cleaner 10. A retaining member 480 is preferably utilized to assist in releasably retaining the final filter 60 to the vacuum cleaner 10. A filter element 490 such as a paper filter element, is disposed within the enclosure formed by the outer cover plate 400 and the walls 410, 420, 430, and 440.

Figure 7:
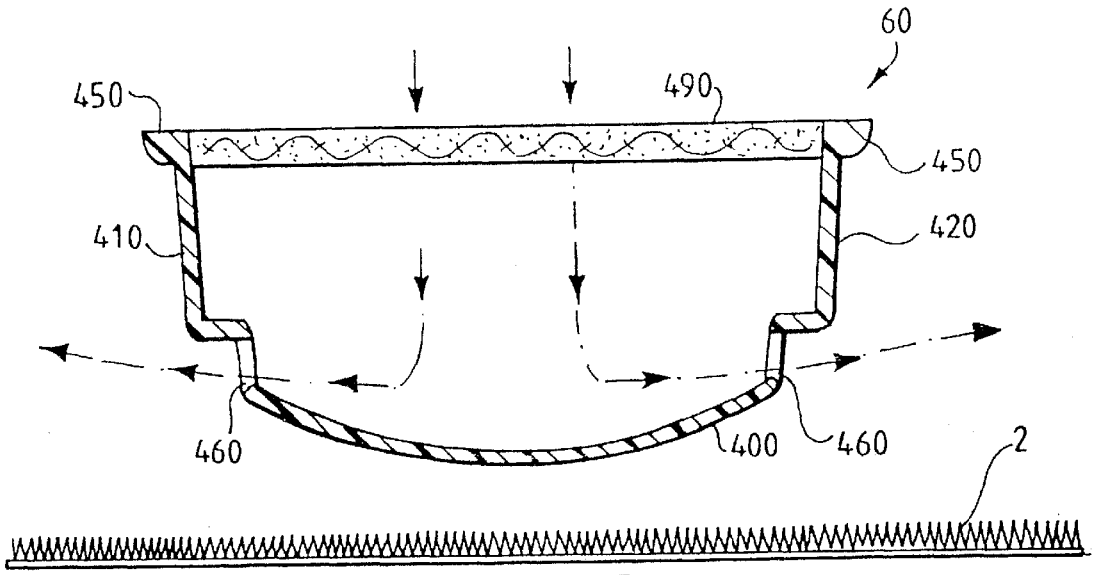
FIG. 7 is a schematic cross-sectional view of the preferred embodiment filter illustrating its orientation to the floor when the preferred embodiment vacuum cleaner is set to a fully reclined position.

Referring to FIG. 7, during operation of the vacuum cleaner 10, air exiting the rear housing 20 flows through the filter element 490 and out of the final filter 60, i.e. through the airflow openings 460, which direct the air laterally outward. The airflow openings 460 are defined along the sidewalls 410 and 420. This is desirable, particularly when the vacuum cleaner 10 is in a fully reclined position such that its upper housing and handle are angled downward and near the floor 2. The laterally oriented openings 460 direct the exiting air stream away from the floor 2. The extent of reclining may be such that the handle is approximately horizontal. This orientation is useful so that the vacuum cleaner 10 has a low profile to thereby enable the vacuum cleaner to be used under furniture items and beds.

The separate and detachable final filter 60 offers additional advantages. By using an external one-piece final filter assembly, there is no need for a separate housing or cover to house and protect the filter element. Furthermore, by utilizing a curved configuration for the outer cover plate 400 of the final filter 60, exiting air is directed slightly upwards from the floor 2 when the vacuum cleaner is in a fully reclined position. This further minimizes debris on the carpet from being blown with the air. This is illustrated in FIG. 7. The rear cover plate 400 further acts as a shield to protect the paper filter element 490 and further deaden noise. In yet another embodiment, some of the various laterally disposed airflow openings 460 located along both sides of the final filter 60 can be eliminated and defined on only one side of the filter housing.

Figure 9:
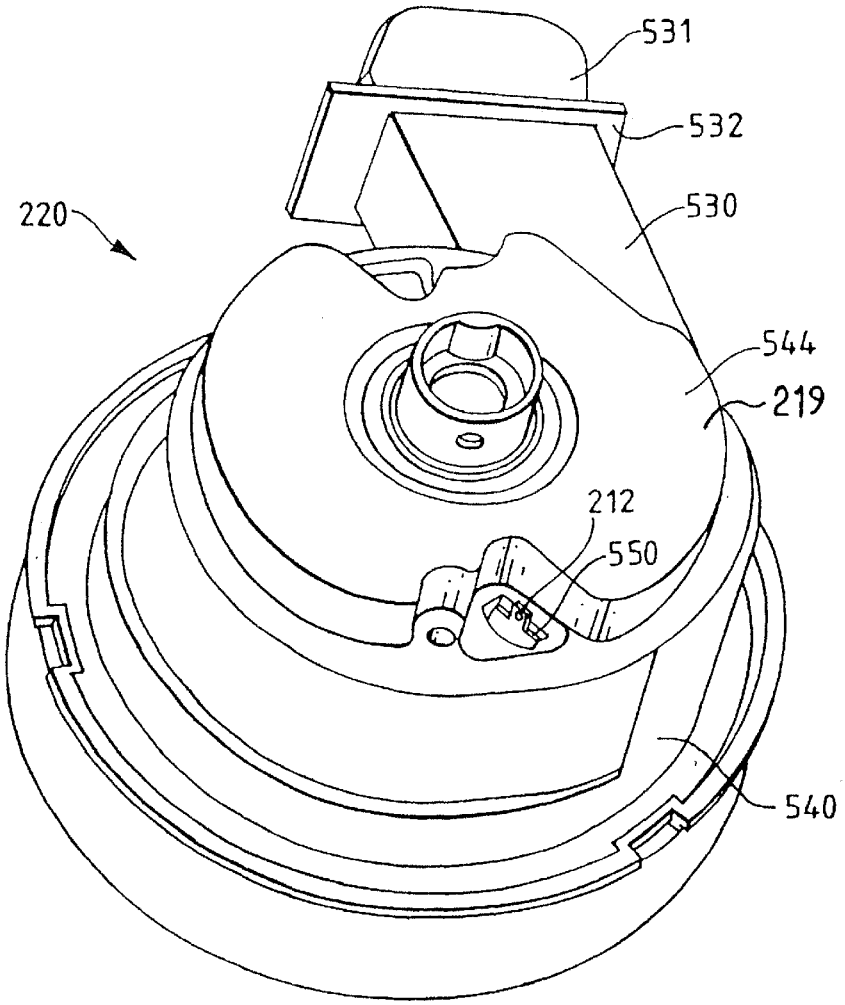
FIG. 9 is a detailed view of the motor shroud shown in FIG. 8.
Figure 8:
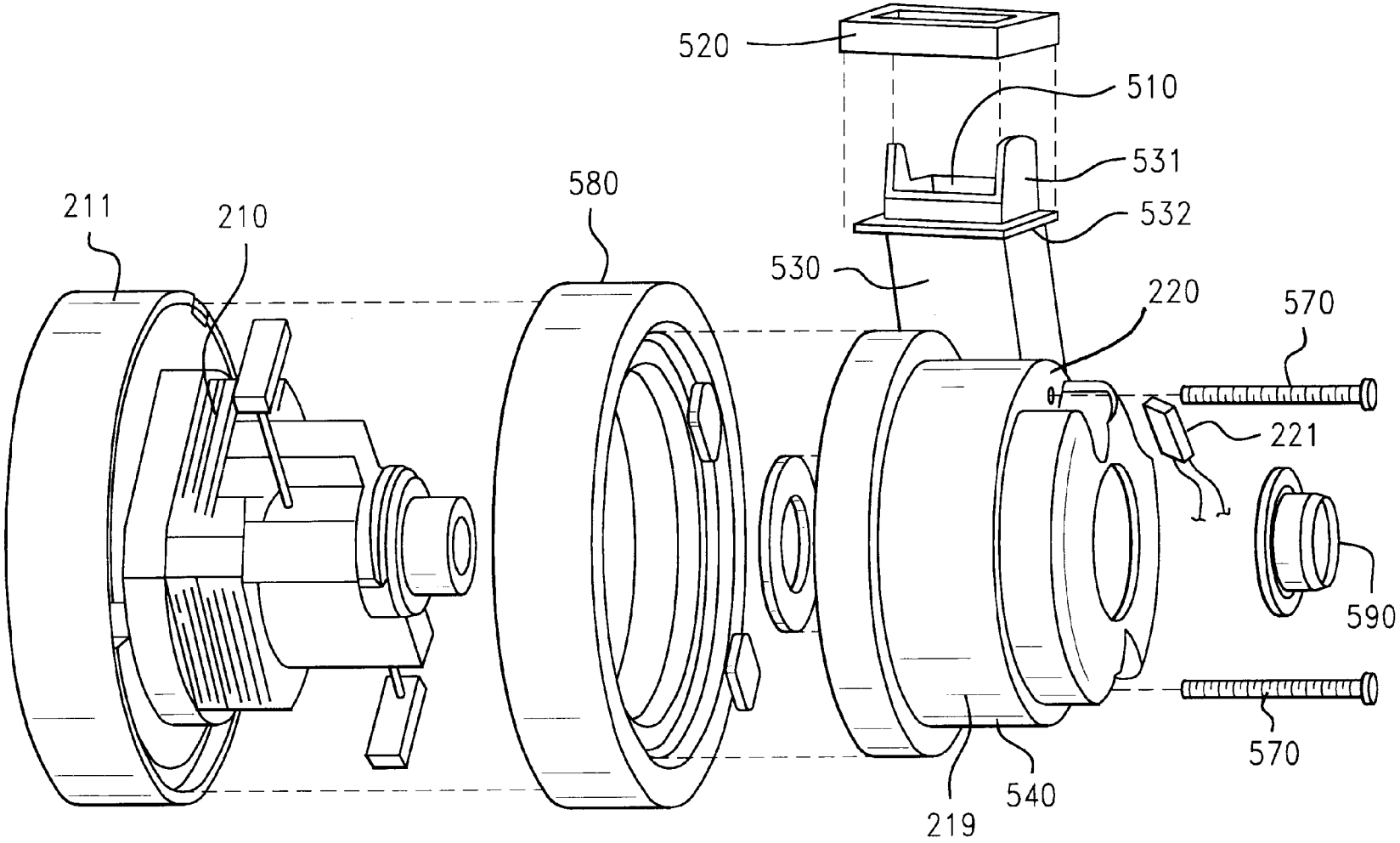
FIG. 8 is an exploded view of a suction motor and a motor shroud used in the preferred embodiment vacuum cleaner.
Figure 10:
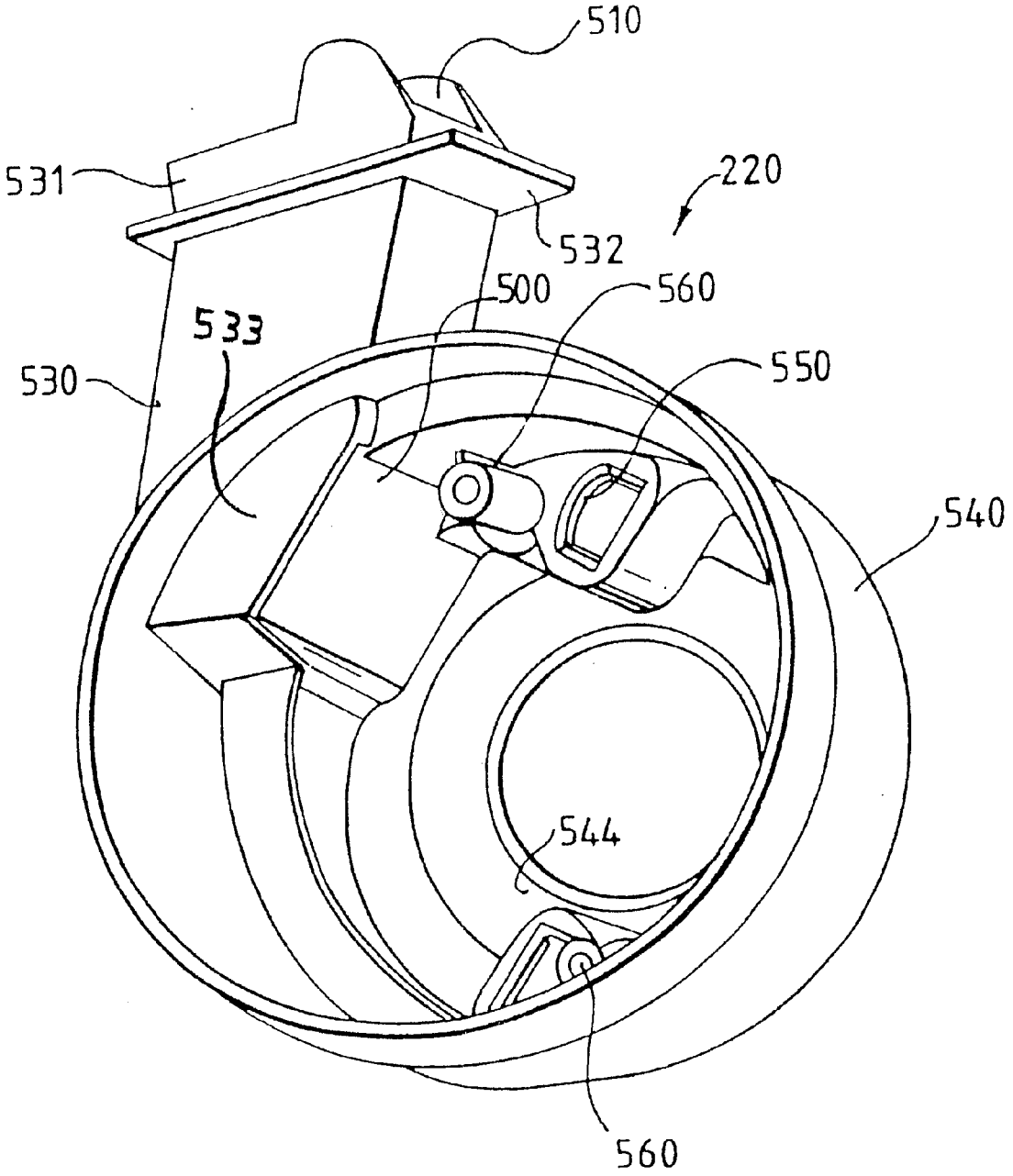
FIG. 10 is another detailed view of the motor shroud shown in FIG. 8.

Referring to FIGS. 8, 9, and 10, the motor shroud 220 and suction motor 210 are illustrated in greater detail. The motor shroud 220 generally encloses the suction motor 210. The motor shroud 220 is preferably cylindrical, comprising an arcuate wall 540 and an endwall 544. The motor shroud 220 comprises a tangentially and outwardly extending air duct 530 defining a shroud opening 510 at its distal end 531. The air duct 530 is in airflow communication with the final filter 60 disposed behind the filter wall 300 as shown in FIG. 2A. The air duct 530 may be attached to the mounting shelf 252. Preferably provided proximate to the distal end 531 of the air duct 530 is a seal seat 532. The seal seat 532 supports a pliable and flexible seal 520 that reduces air leaks between the mounting shelf 252 and the air duct 530 of the motor shroud 220. One or more fasteners 570 and bosses 560 are used to affix and secure the assembly. A sealing and coupling ring 580 is preferably used between the suction motor 210 and the shroud 220. The assembly of the motor 210, the ring 580, and the shroud 220 is preferably disposed within the lower portion of the rear housing 20, and as best shown in FIG. 2A, against the second sidewall 320 of the rear housing 20. Most preferably, the assembly is concentrically aligned with the pivot hub 350 defined in that sidewall. An alignment and support collar 590 is preferably utilized, as shown in FIG. 8 to facilitate support and engagement between the shroud 220 and the pivot hub 350 in the second sidewall 320.

The motor shroud 220 utilizes an interior isolation wall 500 as shown in FIG. 10. The isolation wall 500 generally blocks access to electrical components of the suction motor 210 and serves as a sound insulating barrier to decrease motor noise. Referring also to FIG. 9, the motor shroud 220 also provides one or more terminal apertures 550 that provide access to one or more electrical terminals 212 of the suction motor 210. The preferred embodiment for forming a seal between the motor terminals 212 and the housing of the shroud 220 is by utilizing die cut or molded rubber or plastic members that create a seal within the motor terminal area. This prevents the motor exhaust air escaping through the shroud 220. The present invention includes other embodiments for sealing the region between the motor terminals 212 and the shroud 220 such as, but not limited to, the following. A seal may be formed in this interface region by utilizing a liquid material such as a flowable adhesive, a hot melt adhesive, and silicone sealing materials as known in the art which fill the openings before curing to a hardened state. Alternatively, or in addition, a seal may be formed by utilizing a tight interference fit between the motor terminals 212 or their base, and openings within the motor shroud 220 such as the apertures 550. Alternatively, or in addition, a seal may be formed by insert molding terminals or wires into the motor shroud 220 which can then be electrically connected to the motor terminals 212. Furthermore, a seal may be formed by utilizing a tight interference fit between generally round holes in the motor shroud 220 and wires which connect to the motor terminals 212. It is to be understood that any combination of the foregoing sealing techniques may be used.

The preferred embodiment vacuum cleaner 10 also comprises a thermal cutoff assembly 221 (FIG. 8) utilizing a temperature sensitive safety switch that terminates operation of the suction motor 210 if an excessively high temperature is sensed. The motor 210 cannot be restarted until the switch and sensing unit cool and the electrical circuit is broken and connected again, i.e. the switch is reset. That is, both cooling and reset must occur before the motor 210 can be restarted. The thermal cutoff assembly 221 comprises a switching element having a positive temperature coefficient characteristic. The switching element is preferably mounted on the shroud 220 of the suction motor 210 and is wired in series therewith to automatically shut off the motor 210 if excessively high temperatures are sensed or an overheat condition occurs Overheating may occur if one or more of the filters 270, 260 or 60 become blocked or excessively plugged, thereby hindering or precluding airflow past the suction motor 210. The motor 210 cannot be restarted until the switching element cools and the electrical circuit is re-established. The electrical circuit is re-established in one of several ways such as by unplugging the vacuum cleaner or turning the power switch off, and then either plugging in the vacuum cleaner or turning the power switch on. The positive temperature coefficient characteristic of the switching element provides an advantage over conventional manual reset thermal cutoff assemblies in that it simplifies the design and eliminates parts otherwise required such as a restart button and related wiring.

Most preferably, the thermal cutoff assembly comprises a positive temperature coefficient resistor and a reset component. The positive temperature coefficient resistor is adapted to switch, at a predetermined temperature such as indicative of overheating or a clogged filter, from a low resistance to a very high resistance. When the positive temperature coefficient resistor switches to a high resistance, the cutoff assembly cuts off electric power to the motor assembly. The reset component prevents the restoration of power to the motor assembly until electric power is disconnected from the cutoff assembly, such as by unplugging the unit or turning the power switch off, and the positive temperature coefficient resistor changes back to a low resistance while the unit is disconnected. The change to a low resistance occurs as a result of sufficient cooling of the positive temperature coefficient resistor. Only then may electric power be directed to the motor.

The preferred embodiment vacuum cleaner 10 utilizes a reliable mounting configuration and technique for attaching the handle 90 to the upper portion of the vacuum cleaner 10. Referring to FIG. 1A, the handle 90 is mounted between the upper portion of the rear housing 20 and the front cover 30. Specifically, the lower region of the handle proximate to a lower distal end 95 is placed within a handle cradle 24 provided on the upper interior surface of the rear housing 20. One or more outwardly extending mounting posts 26 are provided, preferably along the length of the mounting cradle 24. It is also preferred to provide a mounting post 26 at the uppermost region of the rear housing 20 to further secure the handle 90. One or more mounting apertures 96 are defined along the lower portion of the handle 90 such that when the handle 90 is placed within the cradle 24, the mounting posts 26 are aligned with the apertures 96 and extend therein. The handle 90 is secured to the rear housing 20 by attaching the rear cover 30 over the handle 90 disposed and aligned within the cradle 24. It is also contemplated that a similar cradle may be provided on the interior surface of the front cover 30, preferably with mounting posts that would engage additional mounting apertures defined in the handle 90.

Figure 13:
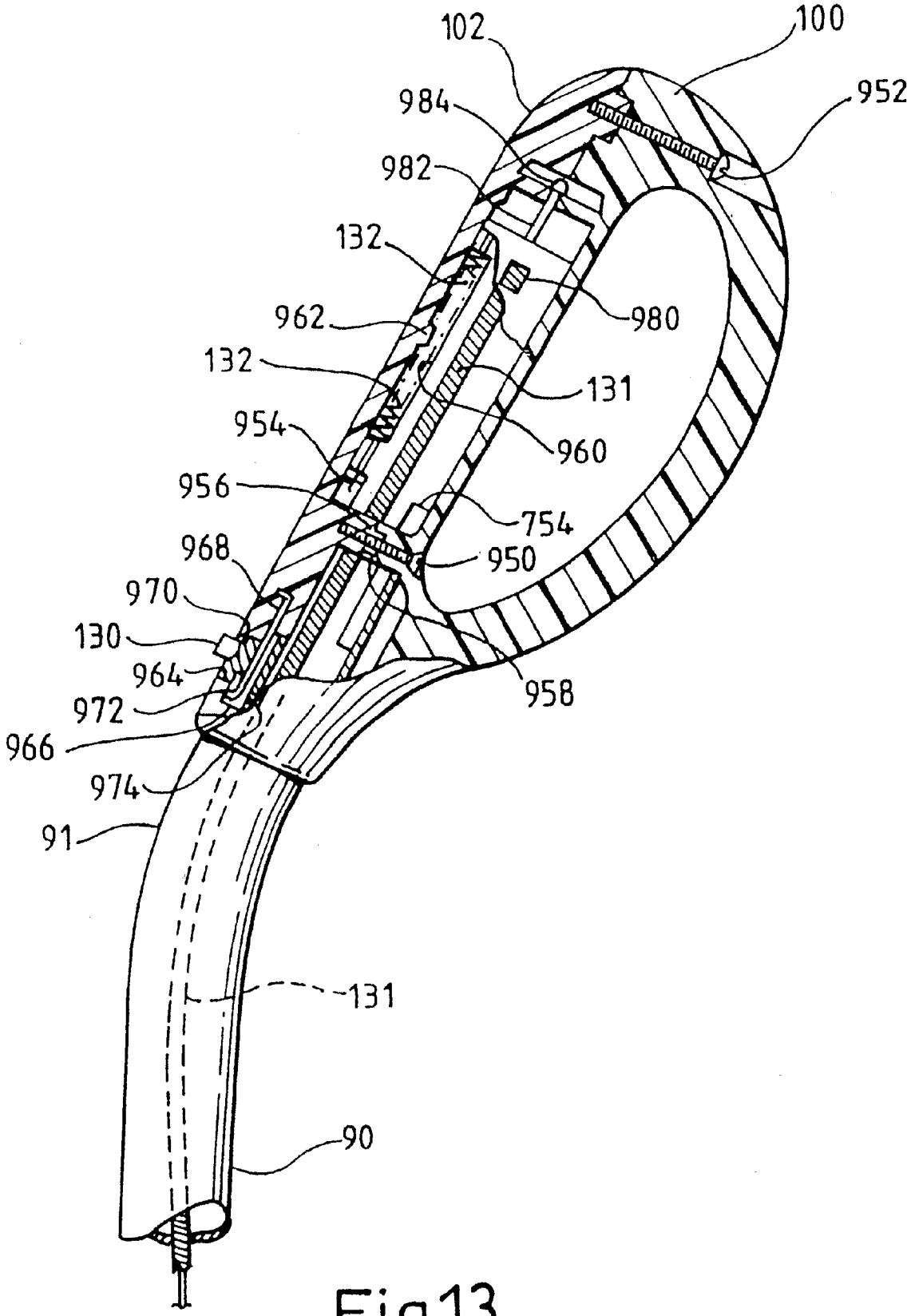
FIG. 13 is a partially cross-sectional view of the handle assembly.

The preferred embodiment vacuum cleaner 10 utilizes a transmission control cable configuration substantially as shown in U.S. Pat. No. 4,249,281. Referring to FIGS. 1A, 2B, and 13, it will be noted that the transmission neutral lock mechanism 130 is disposed on the handle 90 and the transmission 240 is disposed within the upper and lower bases 40 and 180, respectively. The handle assembly comprising the cover 102 and the grip 100 is preferably of a plastic material and is clamped together by means of screws 950 and 952. For this purpose suitable slots 954 may be provided on opposite sides of the upper end 91 of the handle 90 through which losses 956 and 958 extend to engage one another. This mounting thereby covers the upper end of the handle 90 and inhibits removal of the handle assembly therefrom and yet permits the handle assembly to move slidably axially at the end of the handle 90. This mounting of course also inhibits relative rotation between the handle assembly and the handle 90.

A further slot 960 is provided extending axially and adjacent the end 91 of the handle 90 and a boss 962 extends centrally into this slot from the handle cover 102. Helical springs 132 are affixed to opposite sides of the boss 962 and extend in opposite directions for connection to the insides of the handle 90 at opposite ends of the slot 960. The springs 132 serve to hold the handle assembly at a central position with respect to the slot 960, while permitting resilient movement back and forth therefrom, depending upon the forces applied to the handle assembly.

In addition, an axially extending slot 964 may be provided at one end of the handle assembly, with a groove 966 underlying the slot 964 and having somewhat greater dimensions. The mechanism 130 is slidably mounted with an enlarged base in the groove 966 and a push-button end extending through the slot 964. A leaf spring 968 extends in the groove 966 between the handle 90 and the mechanism 130, and has one end thereof fixed with respect to the cover 102, for example by extending into a radially outwardly extending aperture 970 at the end of the groove 966. The other end of the leaf spring 968 is formed with a projection 972 toward the handle 90, the projection 972 being aligned with a hole 974 in the wall of the handle 90 in the central or neutral position of the handle assembly. The spring 978 is normally biased away from the hole 974, with the button in pocket of the slot, but when the button is depressed and urged to a forward position it depresses the spring 978 so that the projection 972 enters the hole 974, to inhibit relative sliding movement of the handle assembly with respect to the handle 90 from the neutral position.

Still referring to FIG. 13, the Bowden wire 131 extends to a suitable clamp 980 adjacent the upper end of the handle assembly. A central wire 982 of the cable has an enlarged upper end 984 which is restrained at the end of the handle assembly. As a consequence, forward or rearward movement of the handle assembly will cause the central wire 982 to slip forwardly and rearwardly within the outer sheath.

The sheathed cable extends from the selector 130 downward through the handle 90 and into the upper portion of the vacuum cleaner 10, i.e. between the rear housing 20 and the front cover 30. The sheathed cable extends further toward the bottom portion of the rear housing 20, and particularly proximate to the pivot hub 350 provided on the first side wall 310 of the rear housing 20. The sheathed cable extends through its pivot hub 350 and into the base of the vacuum cleaner 10. The cable is connected to a transmission shifting yoke that utilizes a linearly displaceable shifting member which effects shifting to the transmission 240. The active or movable end of the cable is attached to the shifting member and the end of the sheath is attached to a stationary support post provided in the vicinity of the shifting member. In the assembled vacuum cleaner 10, movement of the selector 130 is transmitted to the displaceable shifting member by the control cable.

Figure 11:
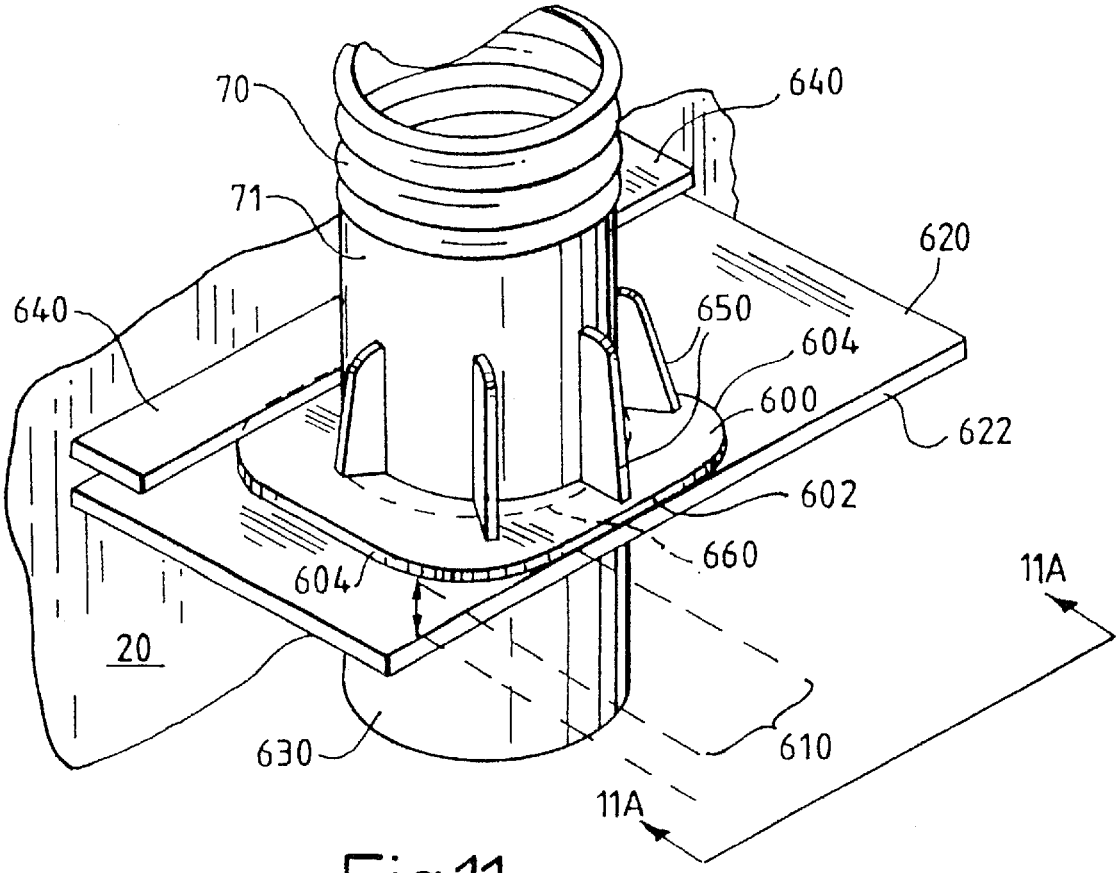
FIG. 11 is a detailed view of the engagement between a hose adapter and the housing of the preferred embodiment vacuum cleaner.
Figure 11A:
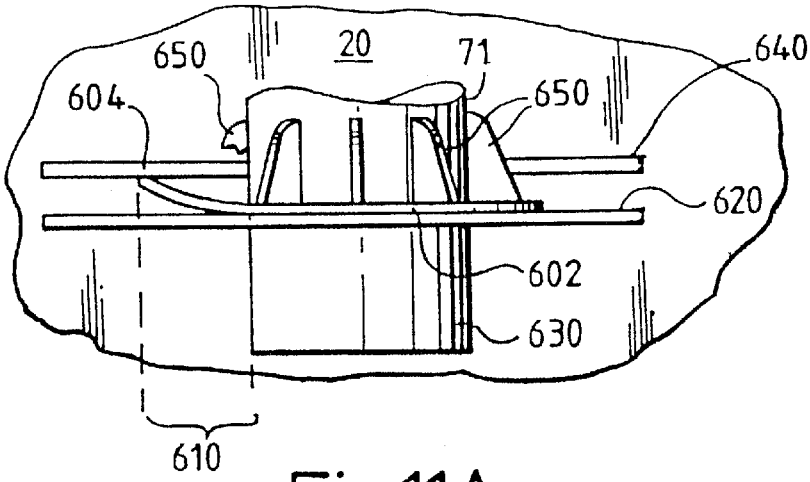
FIG. 11A is an elevational view of the adapter and housing assembly depicted in FIG. 11.

The present invention vacuum cleaner 10 utilizes an elegant locking and affixment configuration between the upper hose 70 and the upper portion of the vacuum cleaner 10. FIG. 11 is a detail of the hose adapter 71 and its engagement with the upper portion of the rear housing 20. As shown in FIG. 1A, the hose adapter 71 is disposed between the upper hose 70 and the rear housing 20. Referring to FIGS. 11 and 11A, the hose adapter 71 preferably comprises an inclined lip or flange 600 extending around at least a portion of the outer periphery of the adapter 71. The lip 600 has an inclined or ramped region designated herein as a cam region 610. The distal end 630 of the hose adapter 71 is inserted within an opening 660 defined in a support ledge 620, generally provided along the interior facing side of the rear housing 20. The bag filter 270 is attached to the end 630 by fitting the end 630 into an aperture 270A in a mounting plate 270B provided at the top of the filter 270. The mounting plate is retained between the support ledge 620 and a parallel ledge 620A. The opening 660 may be an aperture of circular shape, or may be in the form of a notched passageway defined in the support of ledge 620. One or more support ribs 650 may be provided to strengthen the attachment between the lip 600 and the hose adapter 71. The hose adapter 71 is releasably engaged with the rear housing 20 by positioning it over the opening 660 such that the lip 600 is disposed underneath a locking ledge 640. That is, a portion of the lip 600 is disposed between the locking ledge 640 and the support ledge 620. The hose adapter 71 is then rotated, which due to the action of the inclined cam region 610, induces downward displacement of the hose adapter 71, and specifically the distal end 630, into the opening 660. The lip 600 defines an arcuate edge 604 extending around at least a portion of the hose adapter 71. It is preferred to provide a flat region 602 such that when the hose adapter 71 is locked into place upon the support ledge 620, the flat edge 602 is flush, or at least not extending beyond, an outer edge 622 of the support ledge 620. The arcuate edge 604 of the lip 600 preferably extends radially outward from the hose adapter 71 a distance such that when the adapted 71 is not locked into place, i.e. and so that the flat edge 602 is not flush with the outer edge 622 of the support ledge 620, the arcuate edge 604 extends outward beyond the edge 622. This prevents the bag cover 80, or other housing component, from being fully engaged with the rear housing 20. This unique interlock configuration requires that the upper hose 70 be properly coupled to the housing of the vacuum cleaner 10.

The preferred embodiment vacuum cleaner 10 also utilizes a single wheel drive mechanism. The use of a single wheel drive mechanism offers improved maneuverability, a more economical and less expensive drive assembly, simplicity of engaging the transmission to the chassis, versatility of location relative to the cleaning head or base, and improved serviceability for the vacuum cleaner.

The drive assembly and related gear cluster is preferably of the type disclosed in U.S. Pat. No. 4,249,281 to Meyer et al., which is herein incorporated by reference. Furthermore, it is contemplated that the drive motor used in the preferred embodiment vacuum cleaner 10 could be of the variable speed type, controlled by an electronic module, which may be in the form of a diode in series or a potentiometer. This would enable the drive speed to be operator adjustable for the pace desired by each individual user of the vacuum cleaner 10.

Figure 12:
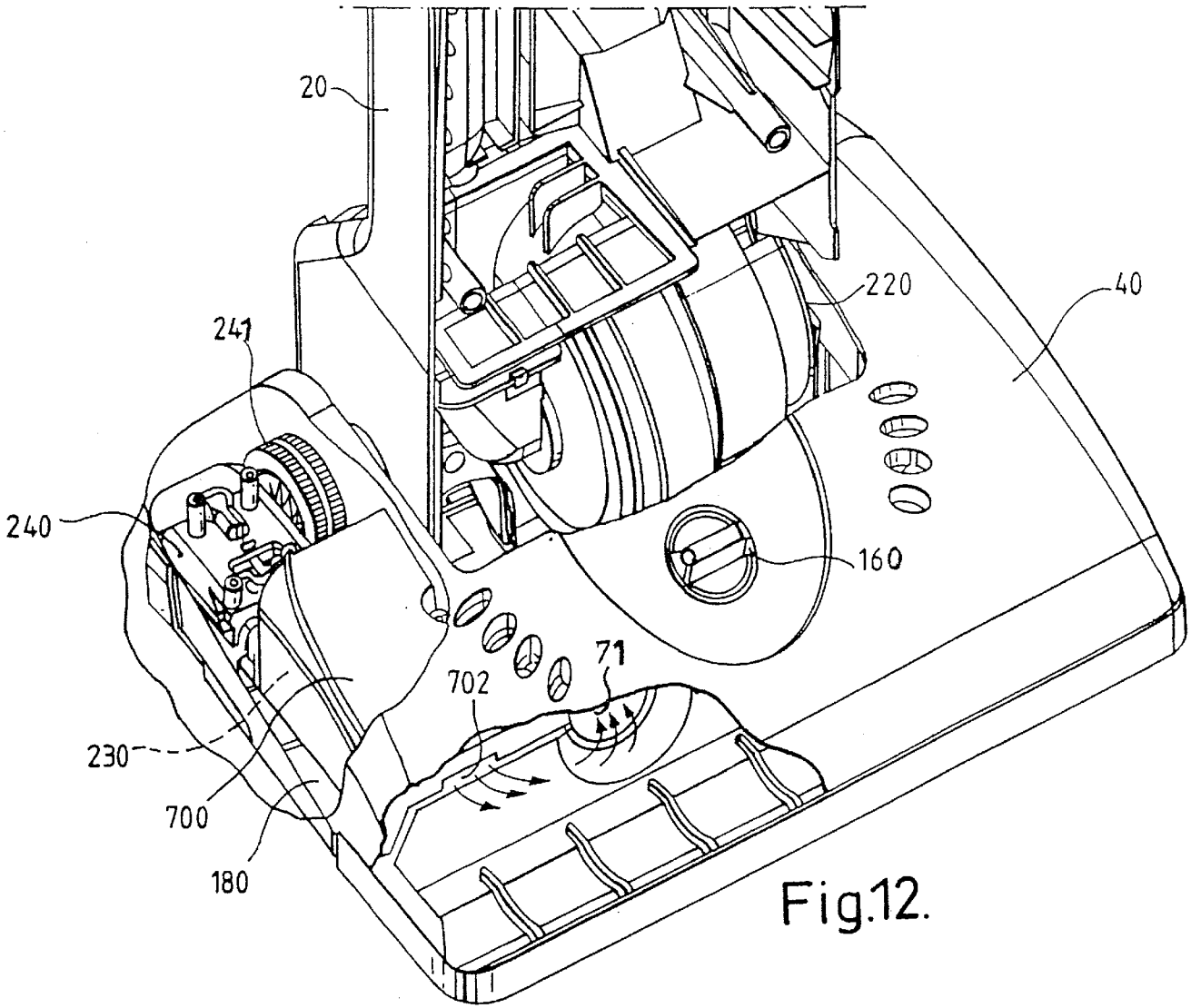
FIG. 12 is a fragmentary view of the vacuum cleaner base illustrating the drive module and air flow therethrough.

As may be seen most clearly in FIG. 12, the single wheel drive mechanism comprising the drive motor 230, the transmission 240, and associated gear cluster and single drive wheel preferably disposed and mounted within the lower base 180. Mounting provisions may be provided on a side region of the lower base 180, such as the left hand side of the lower base 180 illustrated in FIGS. 1A and 12. A drive shaft is used to couple the single drive wheel 241 to the other components of the drive mechanism. Various supporting and mounting provisions can be provided in the lower base 180 for rotatably securing the drive shaft and single drive wheel to the lower base 180. Preferably in this regard, an "eyebrow" notch is formed in a vertical wall or rib in the lower base 180, through which the drive shaft passes. The shaft may be further supported by a bearing disposed within the notch.

It is also contemplated to utilize a clutch in the drive mechanism. A problem encountered in self-propelled vacuum cleaners is fracturing or breaking or other failures in the weakest component in the gear chain. This often results during unpowered, rolling transport of the vacuum cleaner, when the user has failed to place the drive mechanism in neutral. Under these conditions, torque generated by the drivewheel rolling across the floor is transmitted through the drive axle to the transmission and eventually to the drive motor. In the event the total gear reduction is relatively high, so that the drive motor will tend to not turn, the weakest component in the gear chain will fail. In order to remedy this problem, a one-way clutch is added to the drive train to disconnect the torque between the transmission and the drive module gear reduction assembly or drive motor.

The drive mechanism utilized in the preferred embodiment vacuum cleaner 10 is assembled by utilizing a unique technique for achieving proper spacing between the legs of a yoke and the drive gear cluster. Referring to the noted U.S. Pat. No. 4,249,281, and particularly to FIGS. 5 and 6 of that patent, a yoke 120 generally encloses the gear cluster. As described in that patent, a plurality of bearing rivets 130 are provided on downwardly extending arms 124 of the yoke 120. These rivets 130 are utilized to effect proper spacing between the yoke arms 124 and the gear cluster. Although the assembly described in the '281 patent is satisfactory in many respects, the present invention provides an improved assembly that is significantly easier to assemble and eliminates the necessity for the bearing rivets 130.

As noted, it is important to achieve proper spacing between the ends of the gear cluster and arms of the yoke. In accordance with the present invention, one or more spacing washers are incorporated in the assembly. The width and placement of the washers are such that the gear cluster is placed into proper position with respect to the yoke arms. During assembly, the yoke and the gear cluster are introduced into a machine that automatically measures the total axial thickness of the gear cluster, and also measures the interior clearance or distance between the yoke arms. Using these two measured distances, one or more spacing washers are then dispensed and preferably appropriately incorporated into the gear cluster to arrive at a proper spacing between the gear cluster and yoke arms.

Proper neutral adjustment is preferably accomplished by utilizing one or more spacers, i.e. spacing shims, that are inserted in or between a centering plate of the gear cluster. A single set screw, preferably extending through the yoke, is then tightened to lock the gear cluster, now in its spaced and neutral position, in place with the yoke. Upon incorporation into the vacuum cleaner, and connection to a Bowden wire or control cable 131, the shims are removed and the set screw loosened or also removed.

As further illustrated in FIG. 12, the drive motor 230 and the transmission 240 are encased in a shroud 700. Carbon (or other) dust particles produced by the motor and transmission are prevented from escaping to the environment by providing a suction in the area of the drive motor to draw particles into the airflow which passes ultimately through the finial filter 60. The airflow over the drive motor and the transmission is drawn through openings in the shroud 700. This suction is provided by the vacuum motor 210 that provides suction for cleaning as its primary function. According to a preferred embodiment a slot opening 702 is provided in the shroud 700 which communicates with the main floor nozzle chamber.

While the foregoing details are what is felt to be the preferred embodiments of the present invention, no material limitations to the scope of the claimed invention are intended. Further, features and design alternatives that would be obvious to one of ordinary skill in the art are considered to be incorporated herein. The scope of the invention is set forth and particularly described in the claims herein below.

What is claimed is:

1. A vacuum cleaner comprising:

a lower base unit;

an upper enclosure for housing a filter bag, the upper enclosure being pivotable with respect to the lower base unit;

a motor disposed within the lower base unit;

a power cord having a first end affixed to at least one of said upper portion and said base unit, and a second end adapted for connecting to an electrical power source;

electrical conductors extending between said first end of said power cord and said motor, said electrical conductors defining an electrical power circuit to said motor; and a thermal cutoff assembly including a temperature sensor disposed proximate to said motor for measuring the temperature of said motor, said thermal cutoff assembly further including a switching element in electrical association with said electrical conductors, wherein upon the temperature sensor sensing a temperature greater than a predetermined temperature setpoint, said switching element opens said electrical power circuit;

wherein once said switching element has opened said electrical power circuit, said switching element closes said electrical power circuit only upon the temperature sensor sensing a temperature less than the predetermined temperature setpoint and after said thermal cutoff assembly has been disconnected from said electrical power source.

* * * * *

US006484352C1

(12) INTER PARTES REEXAMINATION CERTIFICATE (0355th)

United States Patent

Huebsch et al.

(10) Number: US 6,484,352 C1

(45) Certificate Issued: Mar. 20, 2012

(54) VACUUM CLEANER WITH THERMAL CUTOFF

(75) Inventors: John A. Huebsch, Bloomington, IL (US); Christer T. Kontio, Bloomington, IL (US); William R. Reimer, Normal, IL (US)

(73) Assignee: Electrolux Home Care Products Ltd., Cleveland, OH (US)

Reexamination Request:
No. 95/001,658, Jun. 14, 2011

Reexamination Certificate for:

| | |
|---|---|
| Patent No.: | **6,484,352** |
| Issued: | **Nov. 26, 2002** |
| Appl. No.: | **09/899,010** |
| Filed: | **Jul. 3, 2001** |

Related U.S. Application Data

(60) Continuation of application No. 09/550,571, filed on Apr. 17, 2000, now Pat. No. 6,308,374, which is a division of application No. 08/958,762, filed on Oct. 25, 1997, now Pat. No. 6,085,382.

(60) Provisional application No. 60/035,357, filed on Jan. 10, 1997.

(51) Int. Cl.
*A47L 9/28* (2006.01)

(52) U.S. Cl. ..... 15/339; 15/412

(58) Field of Classification Search ..... 15/339, 15/412

See application file for complete search history.

(56) References Cited

To view the complete listing of prior art documents cited during the proceeding for Reexamination Control Number 95/001,658, please refer to the USPTO's public Patent Application Information Retrieval (PAIR) system under the Display References tab.

*Primary Examiner*—Matthew C. Graham

(57) ABSTRACT

Disclosed is a unique and novel air filtrating, self-propelled upright vacuum cleaner. The filtration system utilizes a HEPA-rated air filter as a final filtering element. The disclosed vacuum cleaner contains numerous other features including a self-propelled drive mechanism.

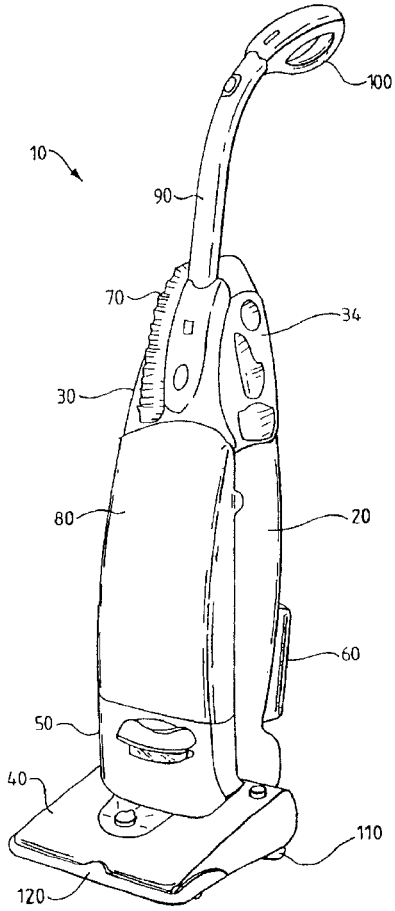

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claim 1 is cancelled.

* * * * *